US009222737B1

(12) United States Patent
Lund et al.

(10) Patent No.: US 9,222,737 B1
(45) Date of Patent: Dec. 29, 2015

(54) PROJECTILE LAUNCHER

(75) Inventors: Bruce D. Lund, River Forest, IL (US); Michael D. Starrick, Maywood, IL (US)

(73) Assignee: LUND AND COMPANY INVENTIONS, LLC, River Forest, IL (US)

( * ) Notice: Subject to any disclaimer, the term of this patent is extended or adjusted under 35 U.S.C. 154(b) by 829 days.

(21) Appl. No.: 13/331,470

(22) Filed: Dec. 20, 2011

Related U.S. Application Data

(63) Continuation-in-part of application No. 12/469,336, filed on May 20, 2009, now abandoned.

(60) Provisional application No. 61/054,741, filed on May 20, 2008.

(51) Int. Cl.
*F41A 1/04* (2006.01)
*F41B 11/00* (2013.01)

(52) U.S. Cl.
CPC .. *F41A 1/04* (2013.01); *F41B 11/00* (2013.01)

(58) Field of Classification Search
CPC ..... F41B 11/54; F41B 11/72; F42B 6/00; F41A 9/72; F41A 1/04; F41F 1/00
USPC ..... 89/7, 132, 1.1, 106; 124/56, 60, 70, 71, 124/72, 73, 1
See application file for complete search history.

(56) References Cited

U.S. PATENT DOCUMENTS 3,888,159 A * 6/1975 Elmore et al. ..... 89/7
4,050,348 A * 9/1977 Graham ..... 89/7
4,109,557 A * 8/1978 Zaucha ..... 89/7
4,148,245 A * 4/1979 Steffanus et al. ..... 89/7
4,281,582 A * 8/1981 Jaqua ..... 89/7
4,341,147 A * 7/1982 Mayer ..... 89/7
4,693,165 A * 9/1987 Magoon et al. ..... 89/7
4,745,841 A * 5/1988 Magoon et al. ..... 89/7
4,852,458 A * 8/1989 Bulman ..... 89/7
4,930,423 A * 6/1990 Bulman ..... 102/440
4,934,242 A * 6/1990 Bulman ..... 89/7
4,949,621 A * 8/1990 Stephens ..... 89/7
5,202,530 A * 4/1993 Stephens ..... 89/7
5,333,594 A * 8/1994 Robinson ..... 124/73
5,398,591 A * 3/1995 Gay ..... 89/33.03
5,499,567 A * 3/1996 Gay ..... 89/7
5,592,931 A * 1/1997 Johnson et al. ..... 124/69
5,699,781 A * 12/1997 Johnson et al. ..... 124/69
5,971,245 A * 10/1999 Robinson ..... 227/10
6,439,216 B1 * 8/2002 Johnson et al. ..... 124/70
6,752,137 B2 * 6/2004 Brunette et al. ..... 124/74
7,254,914 B2 * 8/2007 Lund et al. ..... 42/106
7,337,774 B2 * 3/2008 Webb ..... 124/60
7,658,185 B2 * 2/2010 Perry ..... 124/72
7,806,113 B2 * 10/2010 Skilling ..... 124/73
7,926,408 B1 * 4/2011 Kley ..... 89/41.17
8,015,907 B2 * 9/2011 Tippmann, Sr. ..... 89/7

(Continued)

*Primary Examiner* — Benjamin P Lee
(74) *Attorney, Agent, or Firm* — Invention Mine LLC

(57) ABSTRACT

This application relates to a projectile launcher in which the amount of fuel supplied to the combustion chamber can be varied to shoot the projectile in a lethal or non-lethal mode. The amount of fuel determines the velocity at which the projectile is fired. A low velocity launch on the order of 150 feet per second will be non-lethal at all but very short distance whereas a high velocity launch on the order of 450 feet per second will be non-lethal at a typical range of 100-150 meters but may possibly be lethal at a range of the order of 30 meters or less.

18 Claims, 26 Drawing Sheets

(56) References Cited

U.S. PATENT DOCUMENTS

| | | | | |
|---|---|---|---|---|
| 8,281,776 | B2 * | 10/2012 | Korver et al. | 124/73 |
| 8,322,329 | B1 * | 12/2012 | Sikes | 124/73 |
| 8,651,096 | B2 * | 2/2014 | Sikes | 124/73 |
| 2005/0011507 | A1 * | 1/2005 | Webb | 124/71 |
| 2006/0266206 | A1 * | 11/2006 | Lund et al. | 89/7 |
| 2007/0028909 | A1 * | 2/2007 | Wood | 124/73 |
| 2007/0062363 | A1 * | 3/2007 | Broersma | 89/7 |
| 2007/0186761 | A1 * | 8/2007 | Perry | 89/7 |
| 2009/0199830 | A1 * | 8/2009 | Skilling | 124/3 |
| 2009/0241931 | A1 * | 10/2009 | Masse | 124/76 |
| 2010/0154766 | A1 * | 6/2010 | Skilling | 124/71 |
| 2010/0313742 | A1 * | 12/2010 | Silva | 89/7 |
| 2011/0017189 | A1 * | 1/2011 | Skilling | 124/73 |
| 2011/0073093 | A1 * | 3/2011 | Korver et al. | 124/73 |
| 2012/0031386 | A1 * | 2/2012 | Masse | 124/73 |
| 2012/0216697 | A1 * | 8/2012 | Jacobsen et al. | 102/439 |
| 2012/0298088 | A1 * | 11/2012 | Olden et al. | 124/57 |
| 2013/0092141 | A1 * | 4/2013 | Masse | 124/77 |
| 2013/0104868 | A1 * | 5/2013 | Sikes | 124/77 |

* cited by examiner 10
12
13
14
16
18
20
22
24
26
28
30
32
34
36
38
40
42
44
46
48
50
52
54
55
56
58
60
62
64

100
102
104
106
108
109
110
112
114
115
116
118
122
124
126
128
130
132
134
135
138
139
140
142
144
146
150
152
154
156
158
160
162
164
166
168
170
172
174
180
182
184
186
204
206
208
212
222
224

Fig 10B
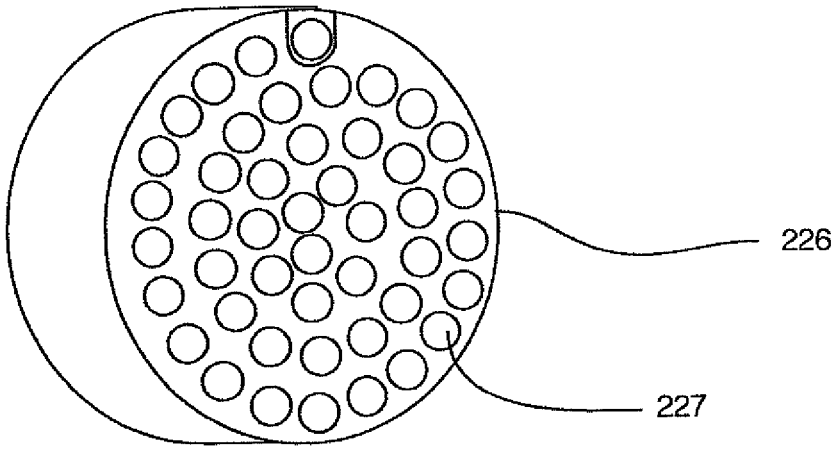
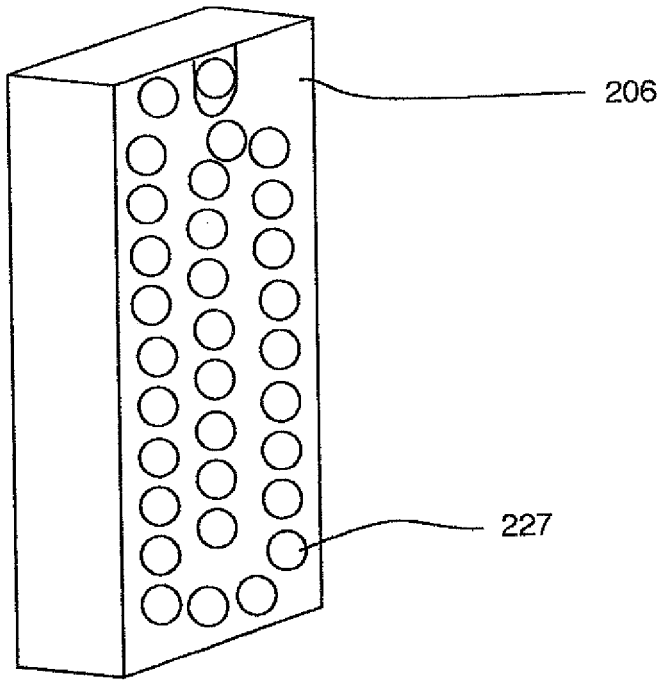
Fig 10A

PROJECTILE LAUNCHER

This application is a continuation-in-part of U.S. Non-Provisional application Ser. No. 12/469,336, filed May 20, 2009, entitled Projectile Launcher, which claims the benefit of U.S. Provisional Application No. 61/054,741, filed May 20, 2008.

FIELD OF THE INVENTION

The present invention relates to a launcher such as a gun to propel various kinds of projectiles. There are various kinds of guns on the market but the industry has long needed a gun that is capable of shooting projectiles at various velocities and distances in a non-lethal as well as lethal mode.

BACKGROUND OF THE INVENTION

In accordance with the invention there is a provided a propellant operated gun that is capable of shooting projectiles at various velocities and distances wherein the projectile can have a lethal or non-lethal effect.

Specifically, the velocity of the projectile can be varied from a low velocity to a high velocity whereby over certain distances they will be in a lethal or non-lethal mode. This is essentially accomplished by varying the amount of the fuel that is introduced into the propellant chamber. In an embodiment of the disclosed invention both a single-shot manually reloaded model has been illustrated as well as one having a magazine to allow the operator to fire the launcher a number of times with a pumping action. It can also be provided with an automatic range finding device to automatically vary the propellant levels to achieve the desired velocity for a given distance so that the projectile is being fired at the desired lethal or non-lethal velocity.

Another embodiment disclosed in FIGS. 11-20 incorporates a semi-automatic or automatic mechanism that cooperates with a projectile magazine to sequentially fire projectiles from the magazine. This differs from the single shot launcher disclosed in FIGS. 1 and 2 and the pump action launcher disclosed in FIGS. 3 through 10.

As an example only, the gun could be set to fire a projectile at approximately 150 feet per second (low velocity) where it would be non-lethal at all but very short distances. If the velocity of the projectile was on the order of 280 feet per second (medium velocity) the projectile would be non-lethal when used for firing at distances of 30 to 100 meters. It is possible that the projectile would be lethal at close quarters on the order of 10 meters or less. If the velocity of the projectile was on the order of 450 feet per second (high velocity), it is non-lethal when used for firing at distances on the order of 50-150 meters. At such velocity it would be possibly lethal if it struck a target at a distance on the order of 30 meters or less.

In addition it is noted that various types of projectiles could be used whose function is to break apart on impact but have sufficient mass so that the impact will stop the combatant but not injure or kill. A typical projectile has a bullet shaped shell having a plastic outer sheathing and contains bismouth.

DESCRIPTION OF THE DRAWINGS

FIG. 5 is a partial cross-sectional view showing the piston separated from the valve plate to permit the flow of exhaust gases there through.

FIG. 10A is a one embodiment of a magazine;

FIG. 10B is a second embodiment of a magazine;

FIG. 20*e* is a component close-up view of the cylinder and valve sleeve wherein the valve sleeve is in a position to open the exhaust and intake ports.

DETAILED DESCRIPTION OF THE DRAWINGS

Figures 1, 2:
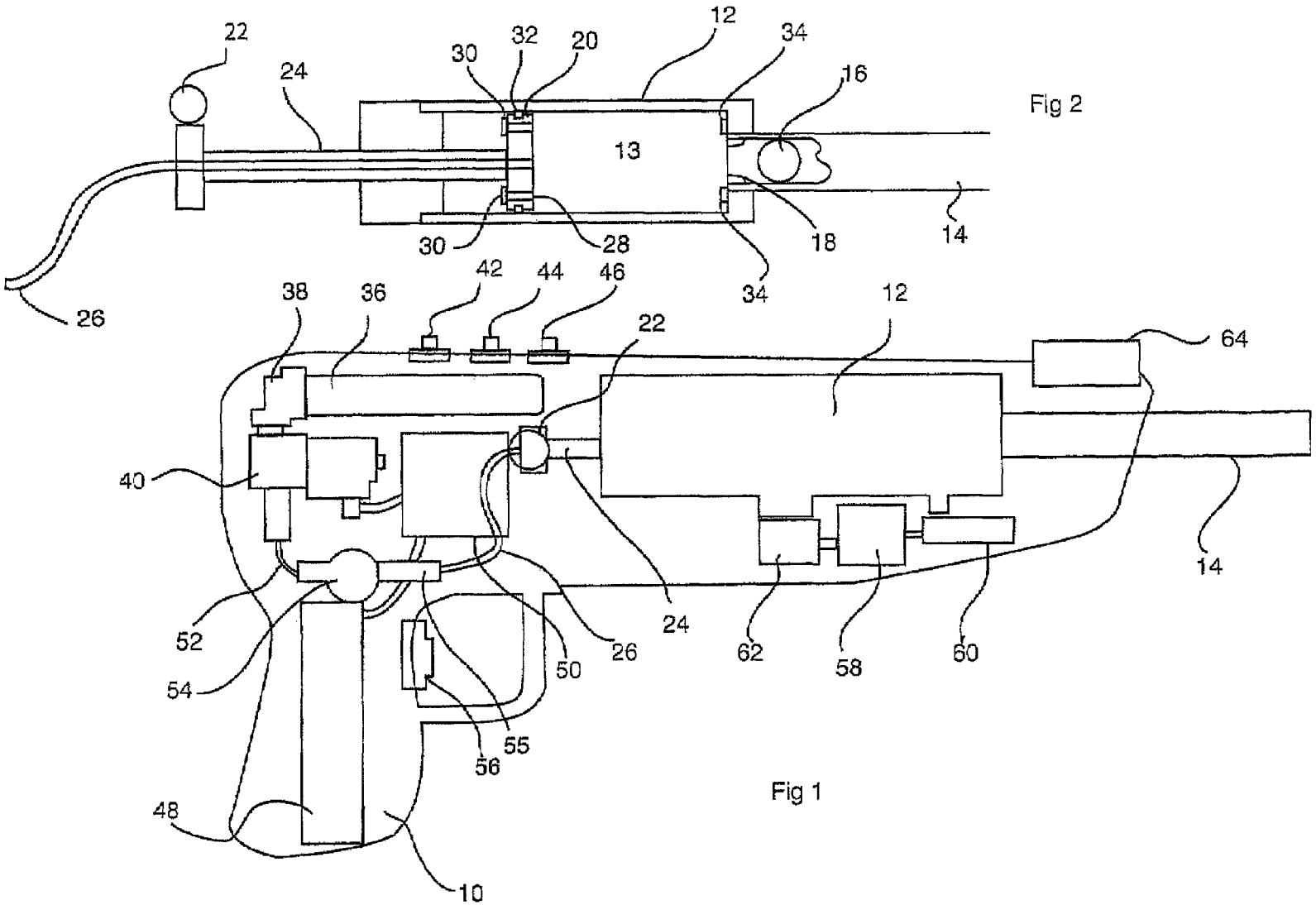
FIG. 1 is an exploded view of a single-shot manually reloaded projectile launcher forming one embodiment of the present invention.
FIG. 2 is a partial cross-sectional view of the launcher of FIG. 1 showing the combustion chamber and a projectile in the barrel to be fired.

Illustrated in FIG. 1 are various components in an exploded form of one embodiment of the launcher or gun 10. The gun 10 includes a combustion chamber housing 12 including a combustion chamber 13 from which extends the barrel 14.

Turning now to FIG. 2 there can be seen in cross-section the details of the combustion chamber 13 and housing 12 and the barrel 14 in which there is located the projectile 16.

The projectile 16 is placed in the barrel 14 and pushed to the back where there is a stop 18 to restrict the projectile 16 from entering the combustion chamber 13. The fit between the projectile 16 and the barrel 14 is sufficiently tight as to allow the projectile 16 to act as a sealing unit for the combustion chamber.

In the embodiment illustrated there is shown a manually movable piston 20 by a knob 22 connected to the piston shaft 24. Extending through the shaft 24 is a fuel hose 26 that directs fuel into the chamber 13 where it is to be ignited. During the manual operation of the launcher, the knob 22 is moved forward to push the air through the exhaust passage 28 in piston 20 and past exhaust reed valves 30.

It is to be noted that the piston 20 is sealed to the interior wall of the combustion chamber housing 12 by a seal ring 32. When the knob 22 is moved rearward the exhaust reed valves 30 are closed and the intake reed valves 34 are opened to allow fresh air to enter the combustion chamber 13. Once the piston 20 is in the most rearward position then a predetermined amount of propellant is introduced as described hereinafter.

The combustion chamber 13 receives propellant fuel such as MAPP gas or other appropriate propellant through an output hose 26. The propellant is stored in the containment vessel 36 that leads to quick connect assembly 38 and flows through a solenoid operated valve 40 that is timed to provide the requisite propellant for the velocity of the launch required.

In the illustrated embodiment there are three switches 42, 44 and 46 shown which when actuated will instruct the microprocessor that is powered by batteries 48 to open the propellant solenoid operated valve 40 a predetermined number of milliseconds.

For example when switch 42 is closed the microprocessor 50 will open the propellant solenoid 40 for a predetermined number of milliseconds to provide sufficient propellant for a low velocity launch on the order of 150 feet per second that will be non-lethal at all but very short distances; when switch 44 is closed the microprocessor 50 will open the propellant solenoid 40 for an increased predetermined numbers of milliseconds to provide sufficient propellant for a medium velocity launch on the order of 280 feet per second which will be non-lethal at a typical range on the order of 30-100 meters but may possibly be lethal at a close range on the order of 10 meters or less; and when switch 46 is closed the microprocessor 50 will open propellant solenoid 40 for an increased predetermined number of milliseconds to provide sufficient propellant for a high velocity launch on the order of 450 feet per second which will be non-lethal at a typical range of 100-150 meters but may possibly be lethal at a range on the order of 30 meters or less.

The propellant then flows through high pressure output hose 52 pressure regulator 54 and check valve 55 into the output hose 26 leading into the combustion chamber 13.

When the launcher is to be operated the trigger ignition switch 56 is depressed to send an electrical signal to the ignition circuitry 58 which is powered by a battery 60 that energizes high voltage coil 62. The high voltage coil produces a spark in the combustion chamber 13 to ignite the propellant air mixture to launch the projectile from barrel 14.

The unit is cycled through to exhaust the spent gases from chamber 12 and bring fresh air into the combustion chamber for the next launch.

It is to be noted that the propellant quantity could be adjusted via an automatic rangefinder 64 that would signal the programmer 50 to adjust the velocity based on the distance to the target and whether it is to be lethal or non-lethal. Also, the rangefinder could include a safety feature therein where the weapon will not fire below a certain distance when it is to be in a non-lethal mode. Examples would be on the order of 5 meters when firing at a low velocity; 10 meters at a medium velocity and on the order of 30 meters when firing in a high velocity mode.

We turn now to FIGS. 3 through 10 that disclose a second embodiment of a projectile launcher incorporating in addition to other features a particular range finder and magazine. This launcher 100 incorporates a pump-action mechanism that cooperates with a projectile magazine to sequentially fire projectiles from the magazine. This differs from the single shot launcher disclosed in FIGS. 1 and 2.

Figures 3A, 3B, 3C, 3D, 3E, 3F:
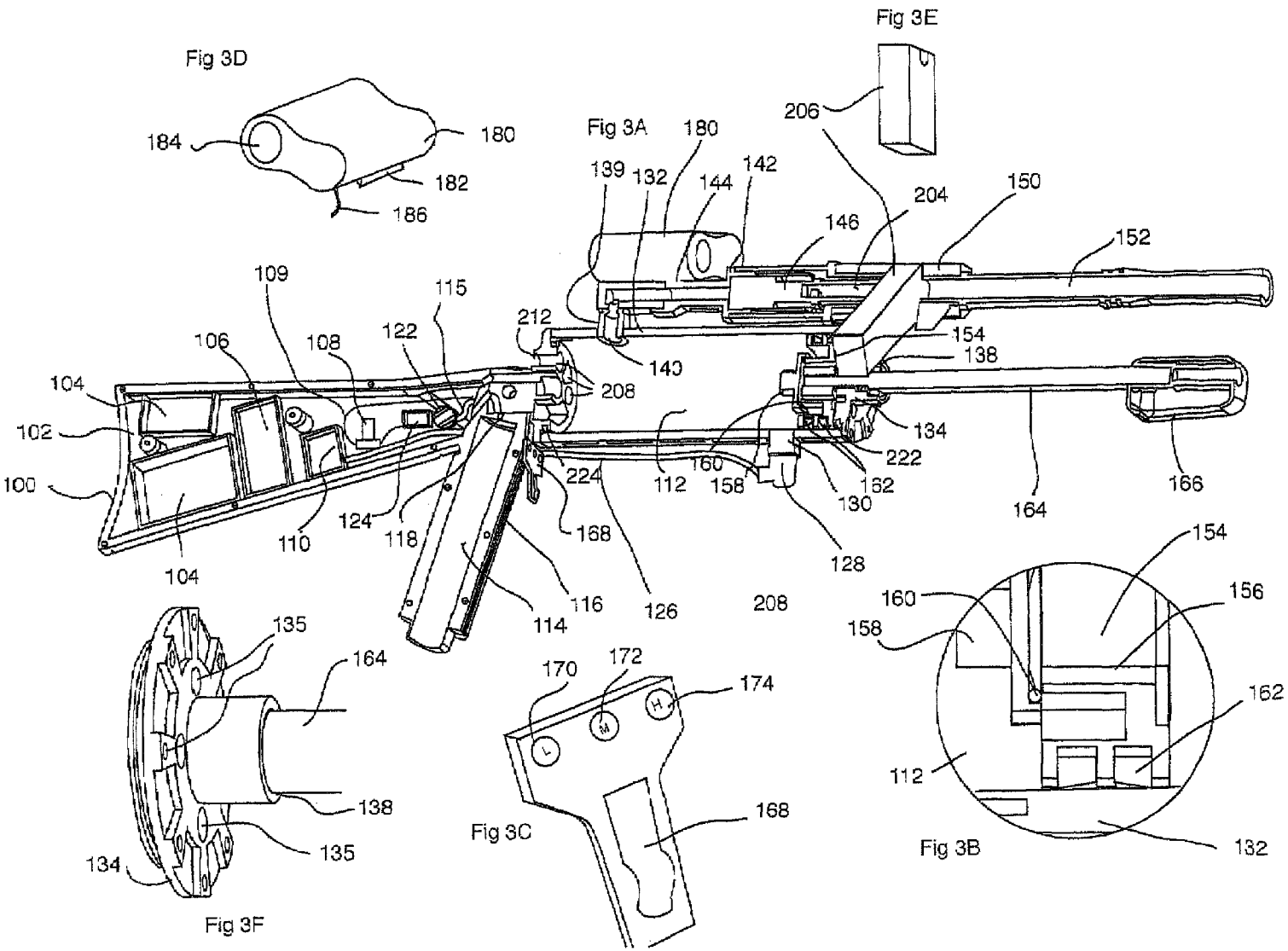
FIG. 3A is a cross-sectional view of a second embodiment of a projectile launcher employing a pump action mechanism for firing projectiles sequentially and includes a magazine and range finder.
FIG. 3B is a partial cross-sectional view illustrating the sealing action between the main piston and cylinder and the valve sealing action between a plate and the piston.
FIG. 3C is an enlarged view of the trigger assembly in schematic form.
FIG. 3D illustrates the details of the range finder mounted on the launcher.
FIG. 3E illustrates a magazine shown in the installed and removed positions.
FIG. 3F is a perspective view of the shaft and end plate.

In FIG. 3A we see a projectile launcher 100 that has a stock 102 that contains batteries 104 for providing power to operate the various components of the launcher 100. In the instant embodiment they consist of 4 AA and one 9 volt battery.

Current from the batteries 104 is supplied to the microprocessor 106 to control the opening of the solenoid 108. Microprocessor 106 also controls the timing of ignition unit 110 to ignite the propellant mixture contained in combustion chamber 112.

Propellant is contained under pressure in fuel canister 114. Fuel canister 114 is located in grip 116 and is held in place by a cap (not shown). Fuel canister 114 has a spring valve 118 located at its apex similar to many aerosol cans on the market. Spring valve 118 pushes against propellant output seal (not shown) and the released Propelant flows through high pressure line 115. Propellant then flows through pressure regulator 122 check valve 124 and into solenoid valve 108 and then through fuel line 109.

Connected to ignition module 110 is ignition wire 126. At the end of ignition wire 126 is a water proof boot 128. The ignition wire 126 is connected to spark point 130. Spark point 130 is attached to cylinder 132 which makes up the cylindrical walls of combustion chamber 112.

Connected to cylinder 132 is front end plate 134 held in place by fasteners (not shown). In front end plate 134 are exhaust ports 135 (see FIG. 3F) as well as shaft seal 138.

Also in cylinder 132 is output pressure fitting 139 that includes passage 140 that directs the combustion gas to the spool valve assembly 142 via spool valve connector 144. Spool valve assembly 142 has spool 146 that controls the flow of combustion gas to the barrel 152. The spool is under spring tension by spring 148 (see FIG. 7A). Spool valve assembly 142 is connected to magazine holder 150 that has barrel 152 connected thereto.

In cylinder 132 there is spring loaded piston 154 for the transfer of spent combustion gases from one side of the piston 154 to the other. See FIG. 5 and the discussion thereof for a description of the components used for the gas exhausting process.

While the above provides a general overview of the launcher we can best describe the details of the various segments of the launcher by reference to enlarged sections since the single sectional view 3A does not provide adequate space for the necessary description.

We will now cover the essential components of the launcher in detailed figures thereof.

In FIG. 3B we see an enlarged view of the relationship of piston 154 to valve plate 158 that has an o-ring seal 160 that allows the combustion chamber 112 to be closed during the combustion process. Around the periphery of piston 154 are cup seals 162 to provide a seal between the piston 154 and the cylinder 132. The shaft 164 on which is located on one end the handle 166 (see FIG. 3A) is connected at its other end to the valve plate 158. As described in detail with respect to FIG. 3A the shaft 164 and handle 166 are shown in the position it takes after a projectile has been fired. Exhaust ports 156 are provided in piston 154 and their function will be discussed in conjunction with FIG. 5.

Figure 9B:
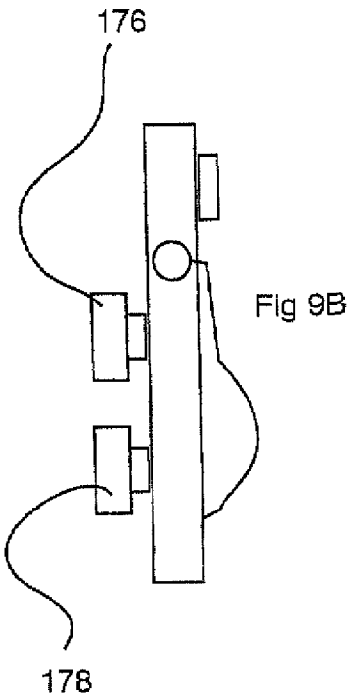
FIG. 9B is a schematic view of the gas and ignition switch assembly.
Figure 9A:
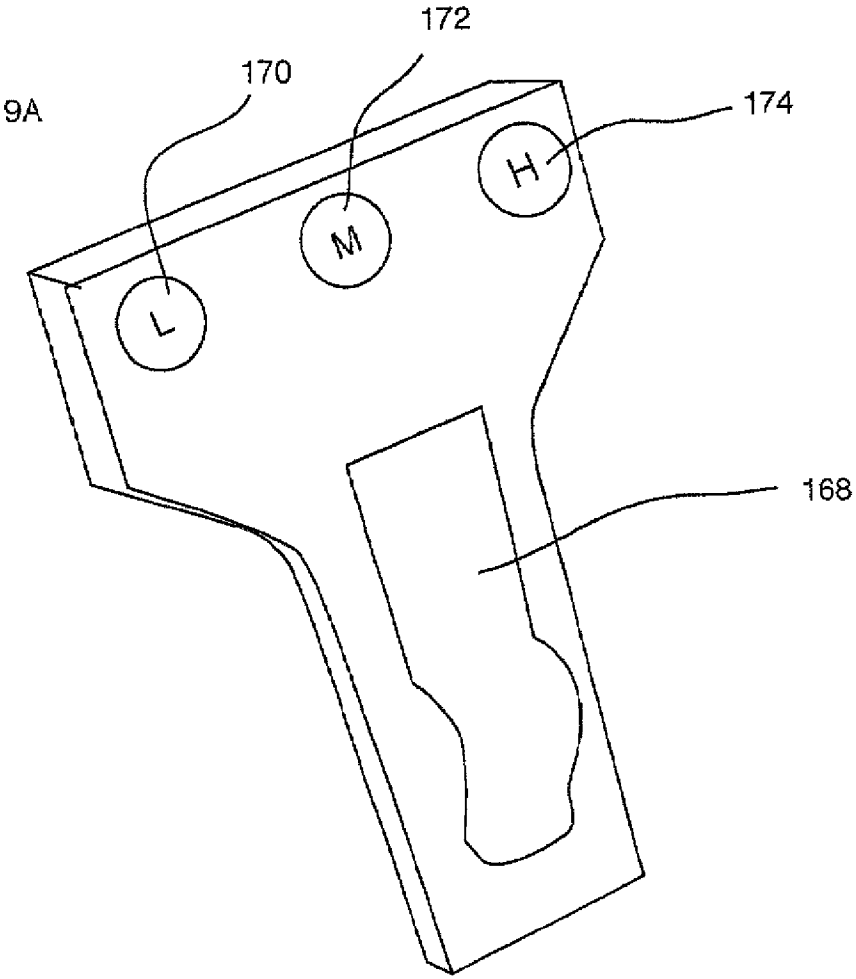
FIG. 9A is a schematic view of the trigger mechanism.

Turning now to FIG. 3C and FIG. 9A there is an enlarged view of the trigger assembly 168 in schematic form. There is shown there 3 switches, 170, 172 and 174 that are connected to the microprocessor 106. These operate in a manner similar to switches 42, 44 and 46 in the embodiment illustrated and described with respect to FIGS. 1 and 2. Switch 170 when actuated results in a low velocity launch, switch 172 in a medium velocity launch and switch 174 results a high velocity launch. These are but examples only and the number of switches used and the velocities resulting therefrom can be varied as desired. Another possible selector could be a rotary switch or a single switch that is pressed a certain number of times to vary the power level.

When the operator selects a power level a signal is sent to the microprocessor 106 which in turn will open the solenoid valve 108 for an appropriate amount of time to allow the proper amount of propellant to flow into the combustion chamber 112 that once ignited will launch the projectile at an appropriate speed to have the desired effect (either lethal or non-lethal). As illustrated in FIG. 9B the trigger 168 works in conjunction with a gas switch 176 to send a signal to initiate the opening of solenoid valve 108. The trigger 168 also works in conjunction with ignition switch 178 to energize ignition module 110. When the operator depresses trigger 168 gas switch 176 is operated before ignition switch 178. Also in the system is a position switch (not shown) that acts as a safety to insure that the piston 154 is in the correct position for firing which working in conjunction with the microprocessor 106 renders the gas switch 176 and ignition switch 178 inoperable if the piston 154 is not in the proper position.

We turn now to the firing of the launcher which is best understood from FIGS. 1A, 7A, 7B, 8A and 8B.

Figure 7A:
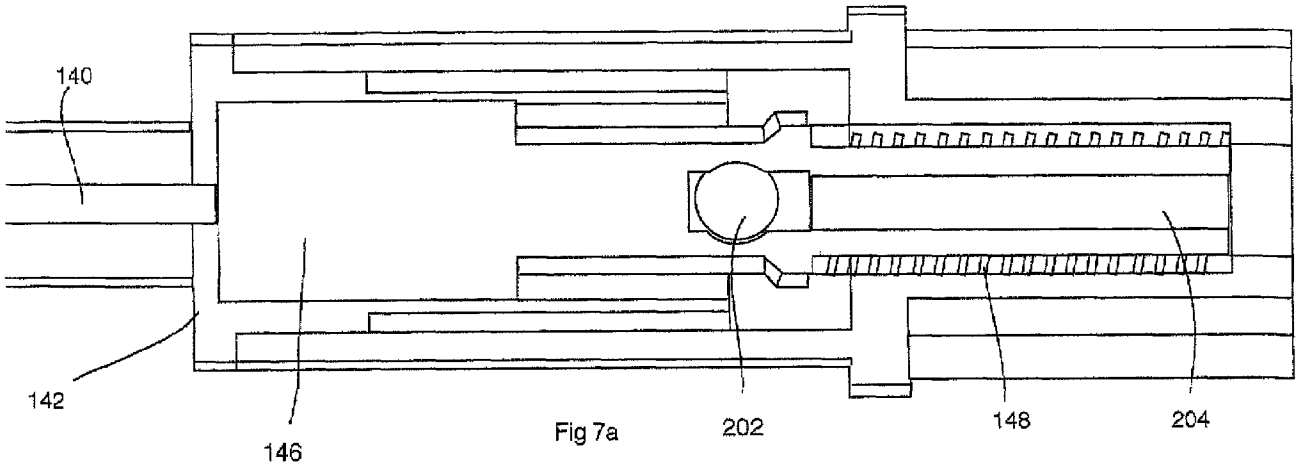
FIG. 7A shows the spool valve controlling the flow of combustion gases in the closed position.
Figure 7B:
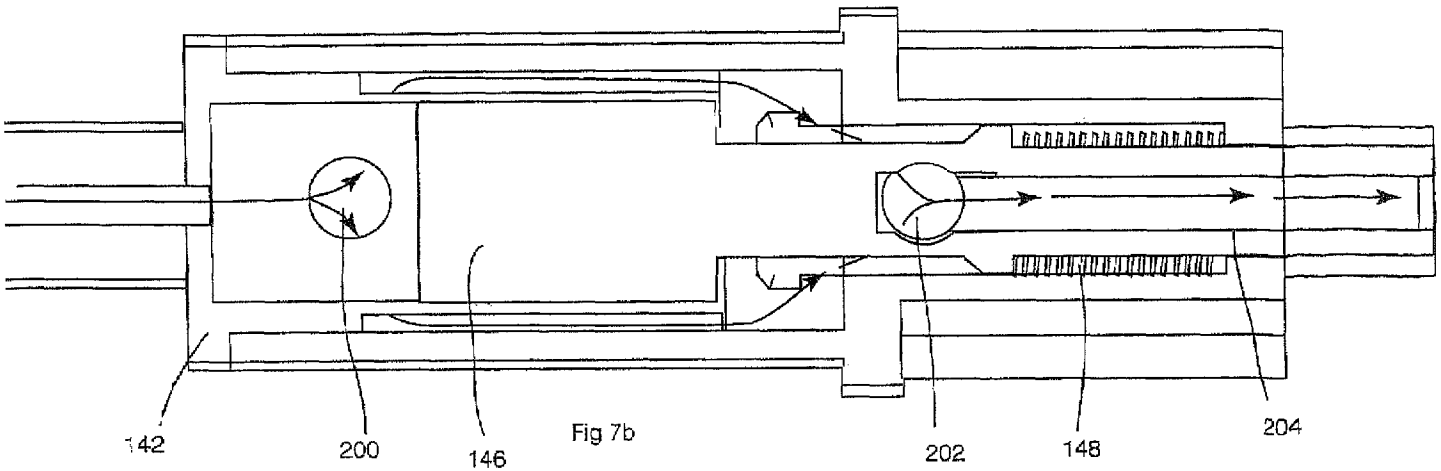
FIG. 7B shows the spool valve of FIG. 7A in the open position.

In FIGS. 7A and 7B there is shown an enlarged view of the spool valve control assembly 142 that controls the combustion gases flowing from the combustion chamber 112 through output pressure fitting 139 to passage 140 leading to the spool valve assembly 142.

In FIG. 7A the spool 146 is held in a rearward position by spring 148. The close tolerance fit between spool valve assembly 142 and spool 146 acts as the upper seal for combustion chamber 112. In spool valve assembly 142 is gas inlet passage 200.

In FIG. 7B we see spool 146 moved forward against spring 148 by the pressure generated by the combustion gases. As spool 146 moves forward gas inlet passage 200 is uncovered and the pressure of combustion gasses passes through the interior passage of spool valve assembly 142 and through gas passage port 202. The combustion gas now transfers through the central passage 204 of spool 146 to propel a projectile (not shown) down the barrel 152. It is to be noted that the forward portion of spool 146 moves the projectile from the magazine 206 into the barrel 152 just before gas passage port 200 opens. The flow path of the combustion gas is indicated by the arrows in FIG. 7B.

After a projectile has been driven the burnt gas remaining in the combustion chamber 112 must be evacuated. After a projectile has been fired the operator grips the handle 166 and the shaft 164 is moved to the position shown in FIG. 4. To facilitate the understanding of the gas exhausting process there is shown in FIG. 5 the piston 154 and valve plate 158 arrangement. When the piston 154 and valve plate 158 are moved to the position shown in FIG. 4 the vacuum created in the combustion chamber 112 results in the gas pressure at the rear end of the combustion chamber moving the piston 154 which is slideable on the shaft 164 against the spring 159 to space the piston from the valve plate 158 to allow the gases behind the piston to flow around the valve plate and through the piston passages 156, the combustion chamber 112 and out the ports 135 in the front end plate 134 (see FIG. 3F).

Figure 6:
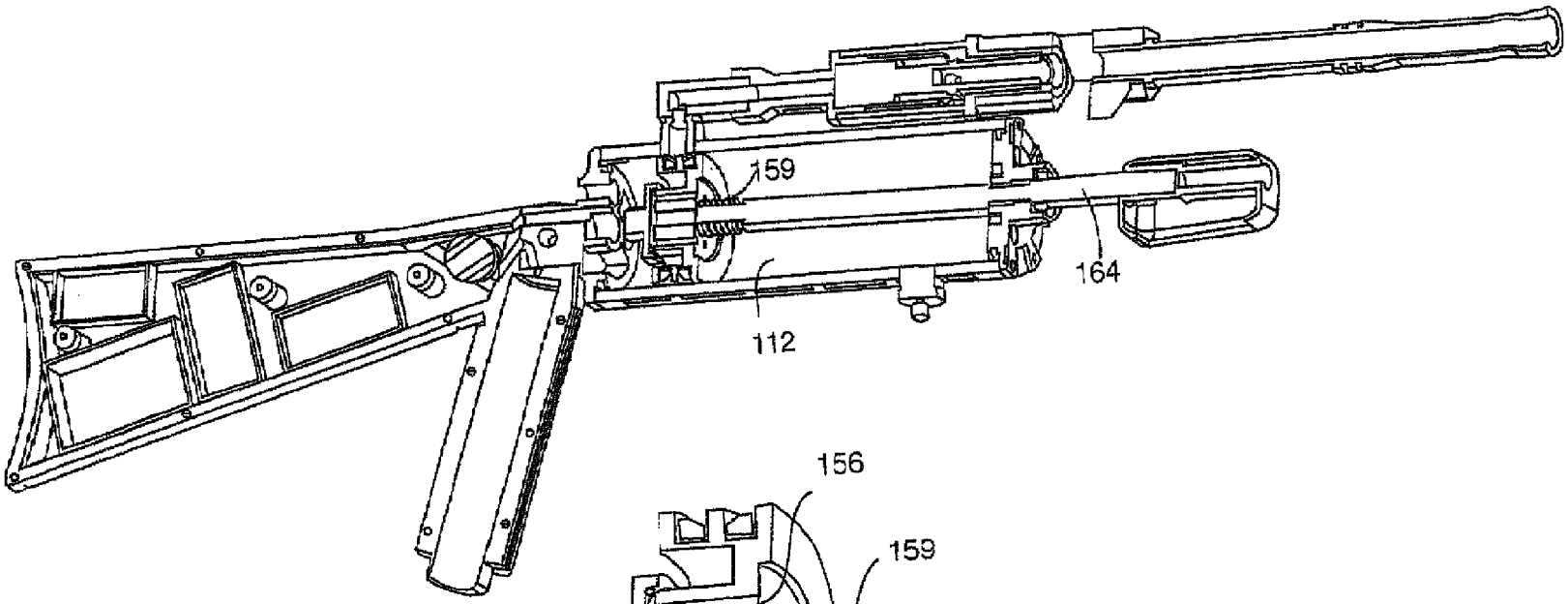
FIG. 6 is a view showing the piston moved forward and check valves (see FIGS. 8A and 8B) opened to allow ambient air to begin entering the combustion chamber.

After the spent gases are exhausted the piston 154 is moved forward as shown in FIG. 6 and ambient air is introduced into the combustion chamber.

Figure 8A:
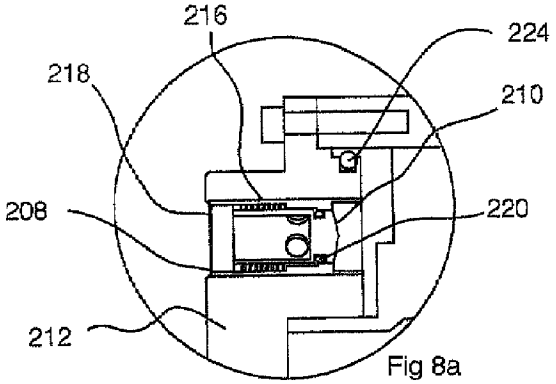
FIG. 8A is a cross-sectional view showing the air intake valve in the closed position.
Figure 8B:
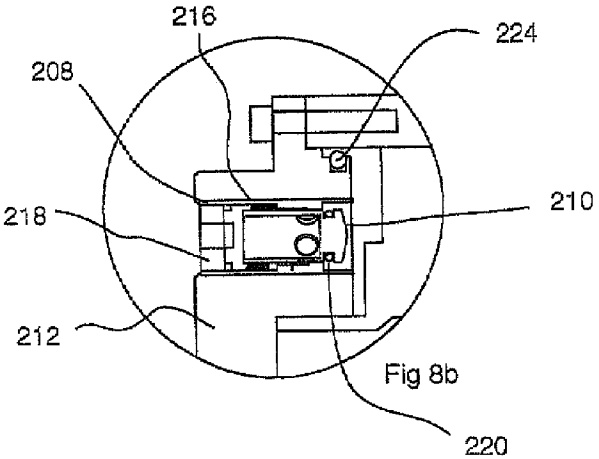
FIG. 8B is a cross-sectional view showing the air intake valve in the open position.

In FIGS. 8A and 8B there is shown an air check valve system whereby ambient air is allowed to enter the combustion chamber after the exhaust gases are evactuated. The air check valve system is comprised of a series of 3 low restriction check valves 210 located in openings 208 in the rear end plate 212. Each valve 210 has an o-ring 220 that seals against the interior of end plate 212. Check valve 210 is held in the sealed position by light spring 216. The entire check valve assembly is held in place by retaining plug 218.

The front plate 134 is sealed to the exterior of the cylinder 132 by o-ring 222 and the rear plate 212 is sealed to the interior of the cylinder by o-ring 224.

In FIG. 8A we see check valve 210 in the sealed position against the interior wall of rear end plate 212.

In FIG. 8B we see the check valve 210 in the open position as it is being moved in response to the vacuum created in the combustion chamber 112 as the handle 166 is moved forward by the operator. Thus ambient air is introduced into the combustion chamber as the piston 154 is moved forward.

Following the discussion of the details of the magazine and range finder the method of operation of the projectile launcher will be described in detail.

FIG. 3D shows the details of the range finder 180 that is mounted on the launcher as shown in FIG. 3A. The range finder 180 is mounted to the launcher 100 by mount 182 in a position that is comfortable for the operator. The range finder 180 has an eye piece 184 with which the operator can determine the range to a target that can be used to advise the operator of the proper power setting. The range finder through the wire 186 can also communicate to the microprocessor 106 to automatically set the power level based on the distance to the target.

In FIG. 3E there is illustrated a magazine 206 shown in the installed and removed positions. An enlarged view of the magazine used in the illustrated embodiment is shown in FIG. 10A. Another representative magazine 226 is shown in FIG. 10B. These magazines are controlled to move a projectile 227 into a position so plunger 146 moves projectile 227 into the barrel 152 just before gas passage port 200 opens.

Method of Operation is as Follows:

With the launcher in the position shown in FIG. 3A a velocity is selected and the trigger 168 is operated and high pressure fuel is introduced into the combustion chamber 112. Essentially, the valve 118 in the canister is opened to allow high pressure gas to flow to the pressure regulator 122 which sets the pressure of the gas flowing to the solenoid valve 108. The solenoid valve 108 is controlled by the microprocessor to open the solenoid valve a predetermined amount of seconds as set by the trigger controls to shoot a projectile at a high, low or medium velocity.

The requisite amount of gas flows into the combustion chamber 112 and the fuel therein is ignited by the ignition module 110 through the igniter wire 126. The spark point 130 ignites gas in the combustion chamber which forms an explosive mixture and flows through the outlet fitting 139 into passage 140 leading to the spool valve assembly 142. The spool 146 moves forward to allow the combustion gases to flow through port 200 around the spool 146 out port 202 and passage 204 into the barrel 152 and eject the projectile 227 at the desired velocity. The projectile is directed from the magazine 206 by the spool assembly into the barrel 152 just prior to the opening of the gas inlet port 200.

Figure 4:
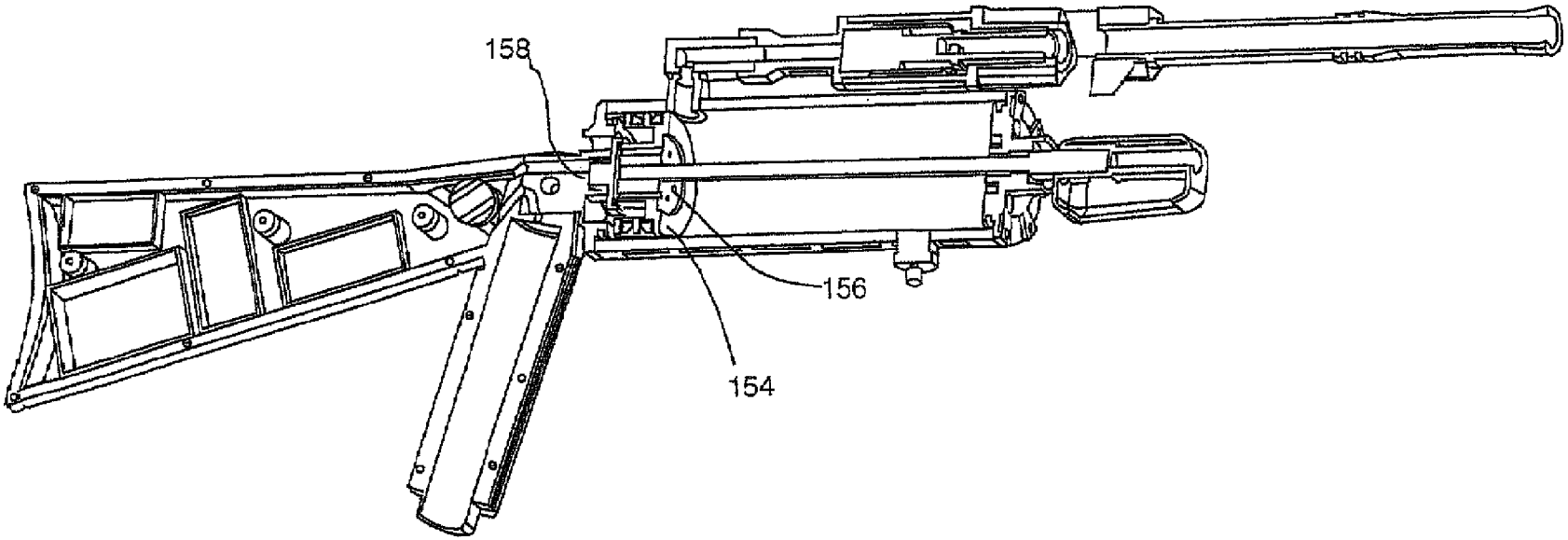
FIG. 4 is a cross-sectional view of the launcher with the Pistol in the extreme rear position with passages open to allow the exhaust gases to flow through the piston and cylinder to exhaust to the atmosphere through the front end of the cylinder.
Figure 5:
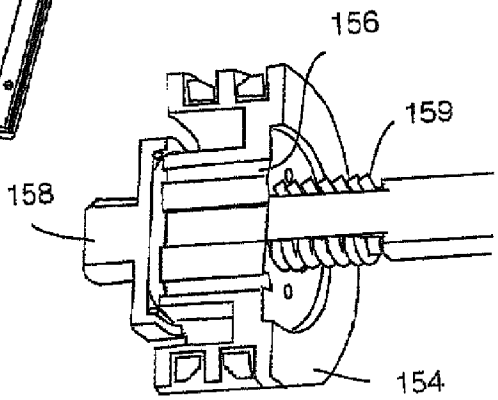

To fire a second projectile 227 the pump handle is moved to the left from that shown in FIG. 3A to the position shown in FIG. 4. The cup seals 162 provide sufficient drag between the piston 154 and cylinder 132 to move the piston 154 away from valve plate 158 against the spring 159 to allow the exhaust gases to flow through the ports 156 in the piston 154 through the combustion chamber and out ports 135 in the front end plate 134 (see FIG. 3F). Ambient air is admitted to the combustion chamber through the opening of the low restriction check valve 210 due to the vacuum in the combustion chamber resulting from the withdrawal of the piston 154 by the handle 166.

The launcher is now in the position shown in FIG. 3A to fire another projectile.

We turn now to FIGS. 11 through 20 that disclose a third embodiment of a projectile launcher incorporating in addition to other features a particular range finder and magazine. This launcher 300 incorporates a semi-auto or automatic mechanism that cooperates with a projectile magazine to sequentially fire projectiles from the magazine. This differs from the single shot launcher disclosed in FIGS. 1 and 2, and the pump-action launcher disclosed in FIGS. 3 through 10.

Figure 11A:
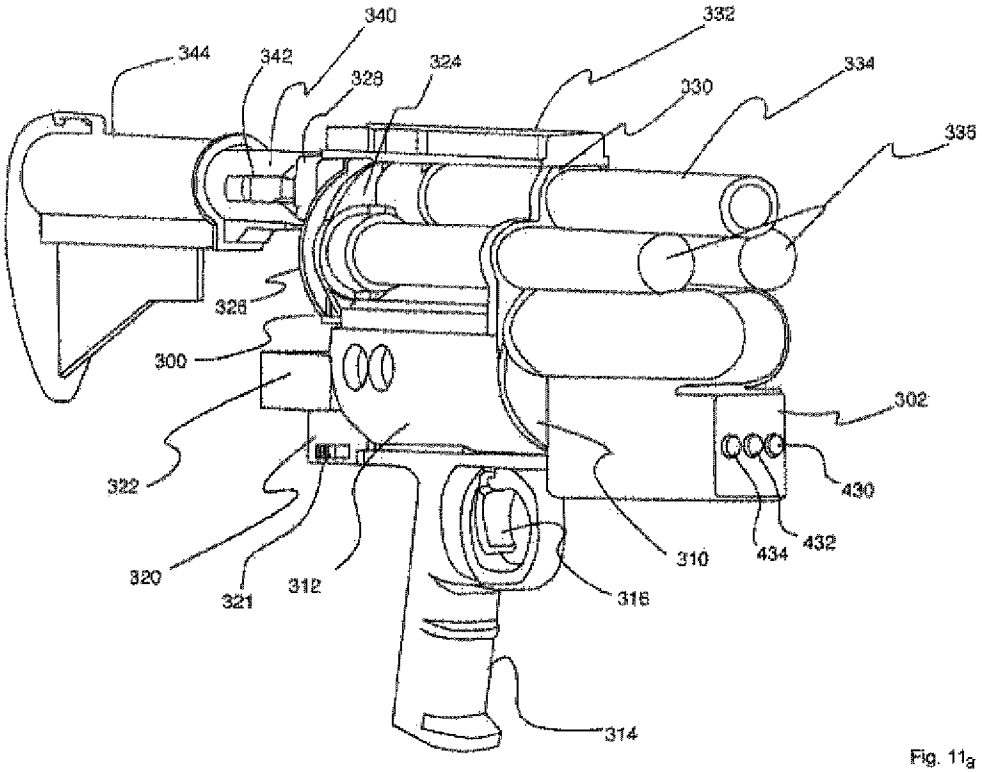
FIG. 11A discloses a perspective view of a third embodiment of a projectile launcher that includes in addition to other features a semi-automatic or automatic mechanism that cooperates with a projectile magazine to sequentially fire projectiles from the magazine.
Figure 14:
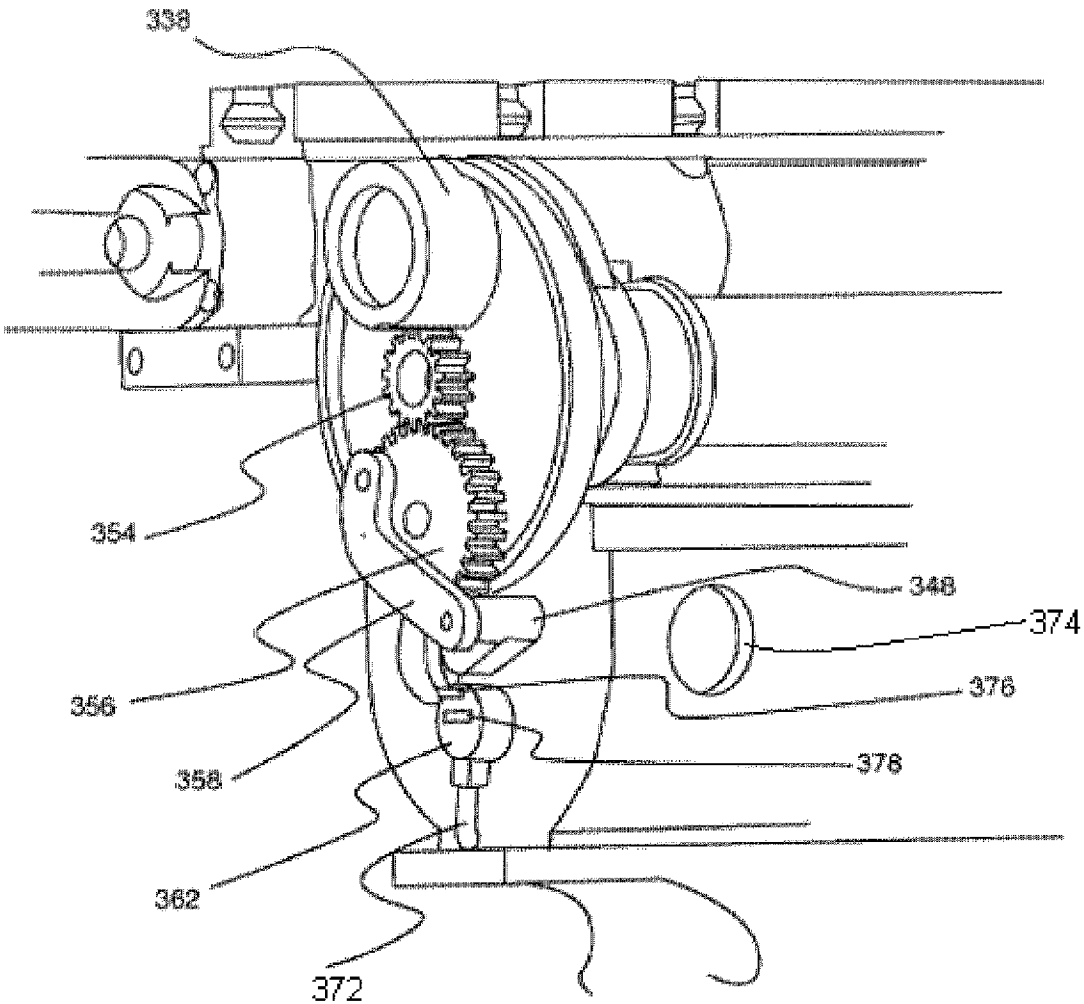
FIG. 14 is a partial perspective view of the gear mechanism for correlating the movement of the projectile shuttle, magazine and valve sleeve as determined by the microprocessor.
Figure 15:
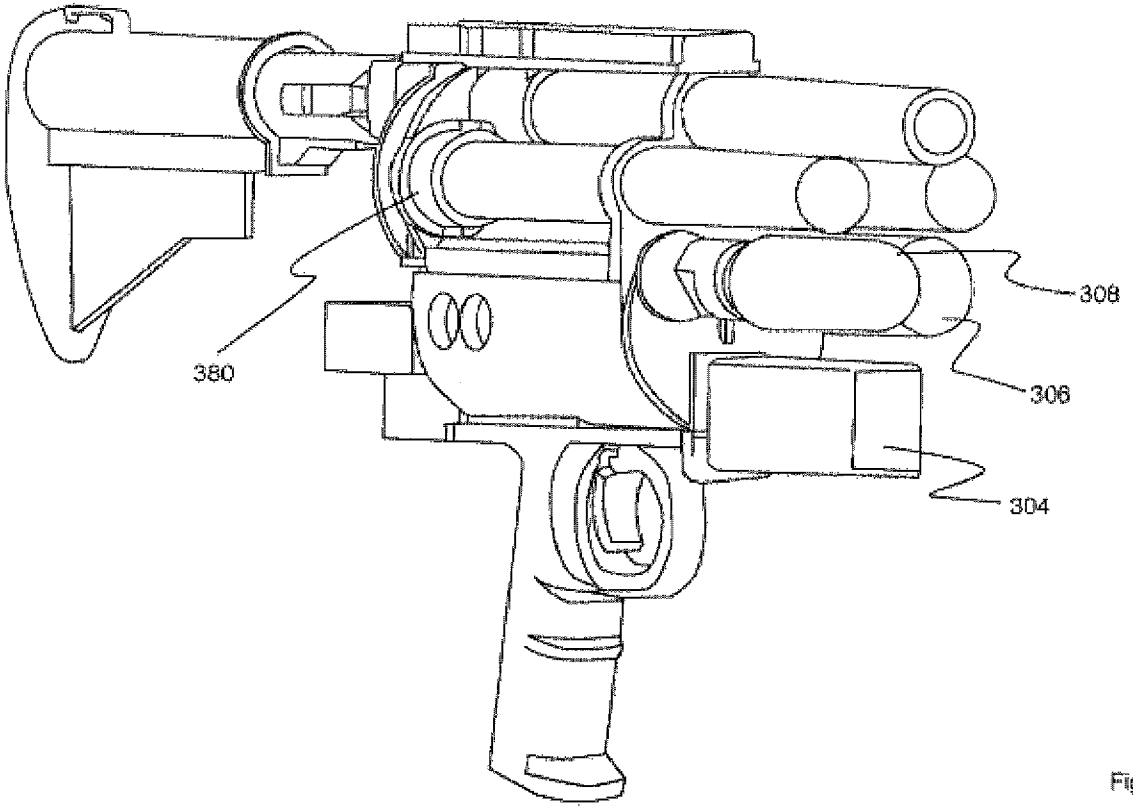
FIG. 15 is a perspective view of the projectile launcher with the front cover removed and illustrating the relative positions of the battery, propellant canister and oxidizer canister.

In FIG. 11 we see a perspective view of projectile launcher 300 that has front cover 302 that contains battery 304, propellant canister 306 and oxidizer canister 308 (see FIG. 15). Front cover 302 is loosely attached to cylinder head 310. Cylinder head 310 is attached to cylinder 312. The lower portion of cylinder 312 has a flat for mounting pistol grip 314. In pistol grip 314 is trigger 316 which operates ignition switch 318 shown in FIG. 16. Attached to the rear of cylinder 312 are microprocessor electronics 320, ignition module 322, shuttle plate 324, transfer tube cover 326 and stock adapter receiver 328. Also attached to the forward portion of cylinder 312 is barrel magazine support 330. Attached to upper portion of shuttle plate 324 and barrel magazine support is host weapon mounting rail receiver 332. Also attached to shuttle plate 324 is barrel 334. In shuttle plate 324 a recess 380 is provided for the conical aperture of magazine 336 to allow a chosen projectile to move from magazine 336 through shuttle plate 324 and into projectile shuttle 338 shown in FIG. 14. Although two magazines are shown as few as one magazine is possible. More than two magazines could be used to provide the operator a selection of projectiles to meet various mission requirements. In FIG. 11 launcher 300 is configured for standalone operation. Inserted in to stock adapter receiver 328 is stock adapter 340 which has spring loaded stock adapter latch 342. Spring loaded stock adapter latch 342 locks stock adapter 340 into stock adapter receiver 328. Stock adapter is appropriately sized to work with a M4 military specification adjustable stock 344. Also in FIG. 11A we see power switch 321, manual input buttons low 430, medium 432 and high 434.

Figure 11B:
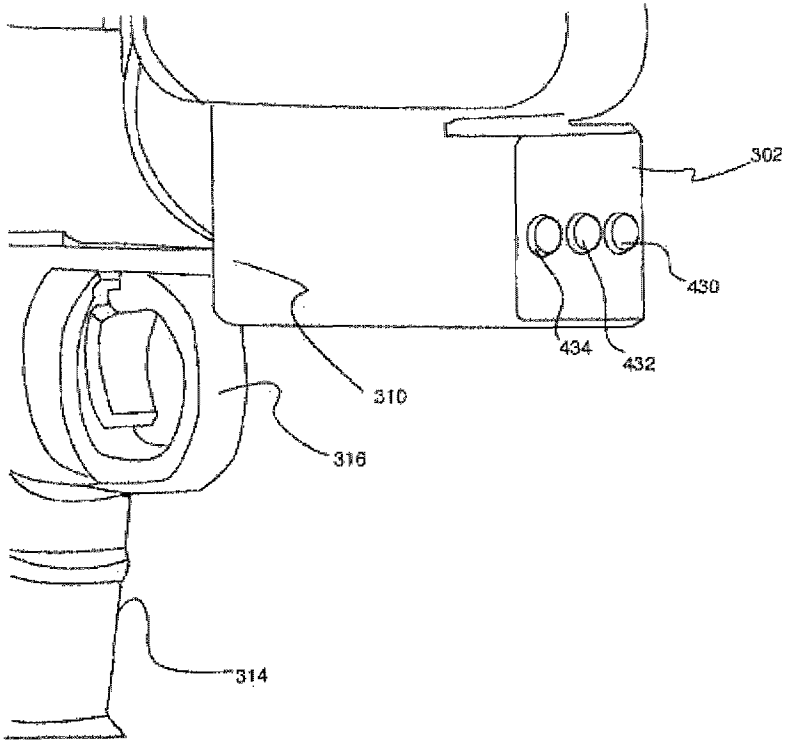
FIG. 11B is a close up perspective view of the front cover and manual input buttons.

FIG. 11B we see a somewhat close up perspective view of front cover 302 and manual input buttons low 430, medium 432 and high 434.

Figure 12:
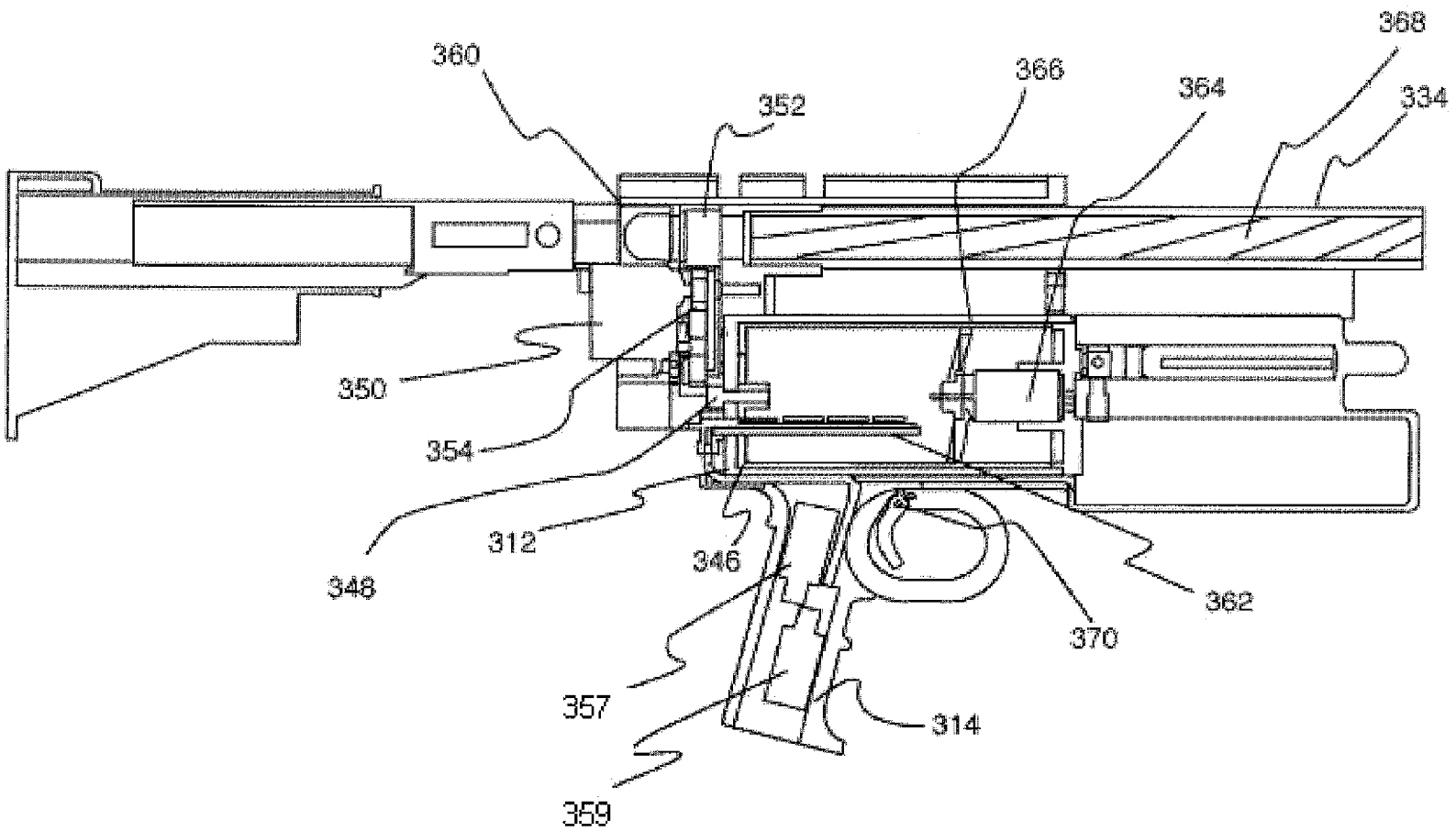
FIG. 12 is a, somewhat center, cross sectional view illustrating internal details of the projectile launcher.

In FIG. 12 we see a, somewhat center, cross sectional view of launcher 300. In cylinder 312 is valve sleeve 346. Mechanically connected to valve sleeve 346 is valve sleeve bell crank 348. Intelligent gear box 350 rotates shuttle 352 and small gear 354. Small gear 354 teeth are in mesh with large gear 356. Attached to large gear 356 is valve sleeve link 358. Valve sleeve link 358 in connected to valve sleeve bell crank 348. This is further illustrated in FIG. 14. Located in pistol grip 314 is propellant solenoid valve 357 and oxidizer solenoid valve 359. Attached to transfer tube cover 326 is transfer tube 360. Passing through cylinder 312 and valve sleeve 346 is fuel tube spark holder 362. Attached to cylinder head 310 is scavenging fan motor 364. Attached to shaft of scavenging fan motor is scavenging fan 366. Located in barrel 334 are rifling lands 368 to impose spin on a projectile as it moved down the barrel 334 under combustion pressures. Also illustrated in FIG. 12 is Trigger pivot 370.

Figure 13:
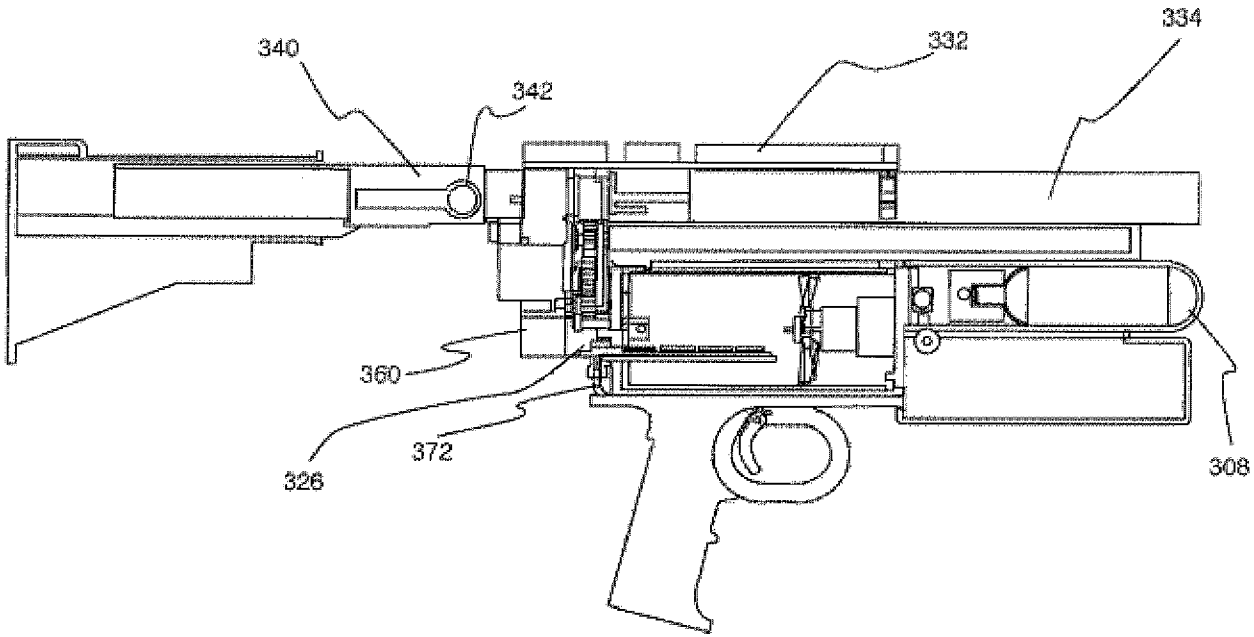
FIG. 13 is a cross sectional view biased toward the right side and illustrating the positioning of the oxidizer canister.

In FIG. 13 we see a cross sectional view biased towards the right side. Oxidizer canister 308 is seen in cross section. Also seen in FIG. 13 is output hose 372.

In FIG. 14 is a close up view of small gear 354, large gear 356, valve sleeve link 358, valve sleeve bell crank 348, and projectile shuttle 338. Also illustrated in FIG. 14 is exhaust scavenging ports 374 located in anterior third of cylinder 312. Also in close up is rear portion of fuel tube spark holder 362. Protruding from fuel tube spark holder 362 are spark wire 376 and ground wire 378. Also seen in FIG. 14 is output hose 372.

In FIG. 15 we see a perspective view of the projectile launcher 300 with the front cover 302 removed. Battery 304, propellant canister 306, and oxidizer canister 308 are seen in their relative positions. Battery 304, propellant canister 306, and oxidizer canister 308 are replenished as needed by user. Also shown in FIG. 15 is recess 380.

Figure 16:
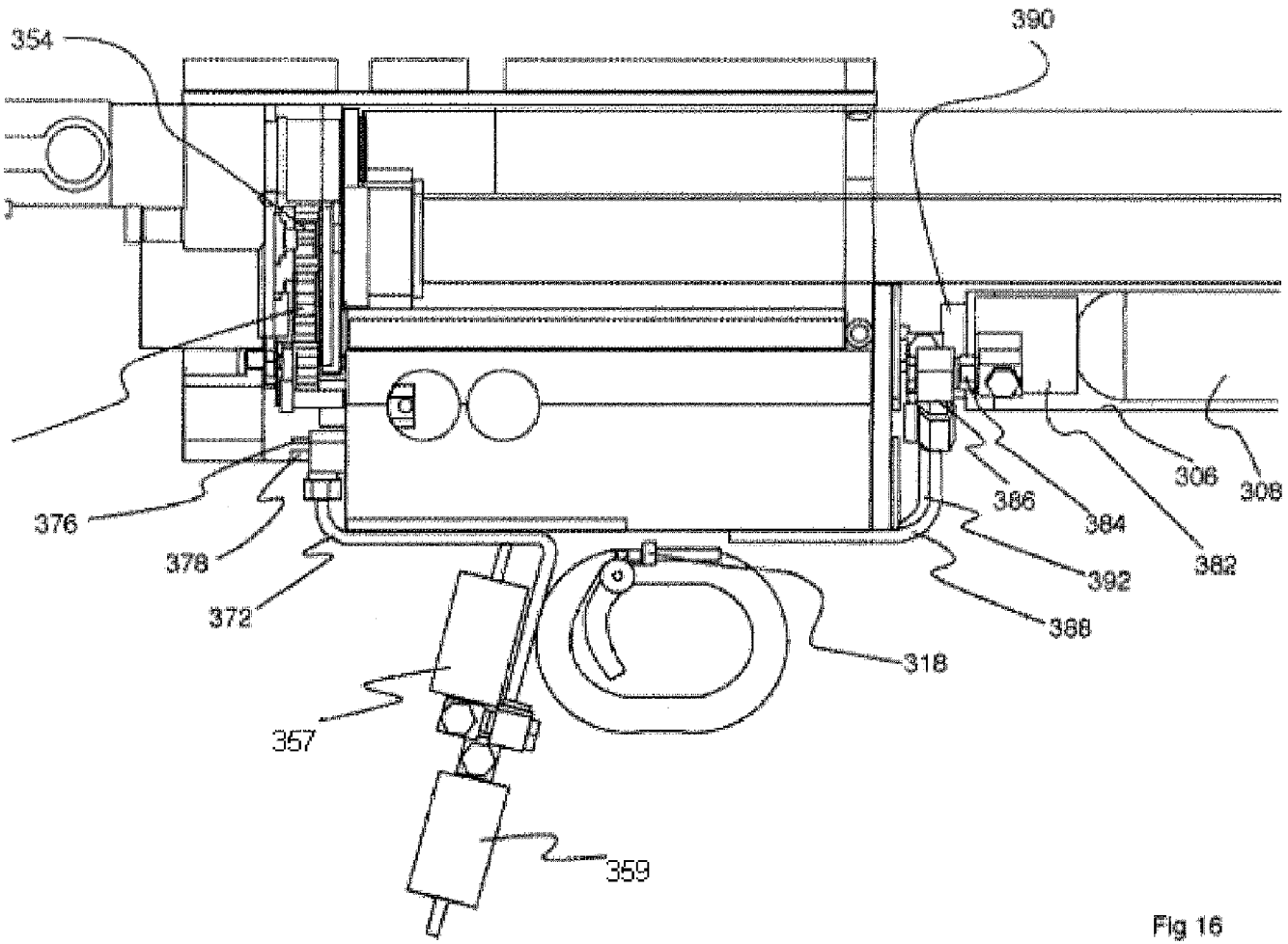
FIG. 16 is a right side view of the projectile launcher with several components removed for clarity.

In FIG. 16 a right side view of projectile launcher 300 with several components removed for clarity. Mechanically connected to oxidizer canister 308 is oxidizer regulator 382. On the output of oxidizer regulator 382 is filter 384. Connected to filter 384 is check valve 386. Oxidizer hose 388 is connected to output of check valve 386. Propellant regulator 390 is mechanically connected to propellant canister 306. Propellant output hose 392 transfers propellant from propellant regulator 390 to propellant solenoid 357. Oxidizer hose 388 transfers oxidizer to oxidizer solenoid valve 359. Output from propellant solenoid valve 357 and oxidizer solenoid valve 359 are plumbed together to output hose 372. Also illustrated in FIG. 16 is ignition switch 318.

Figure 17:
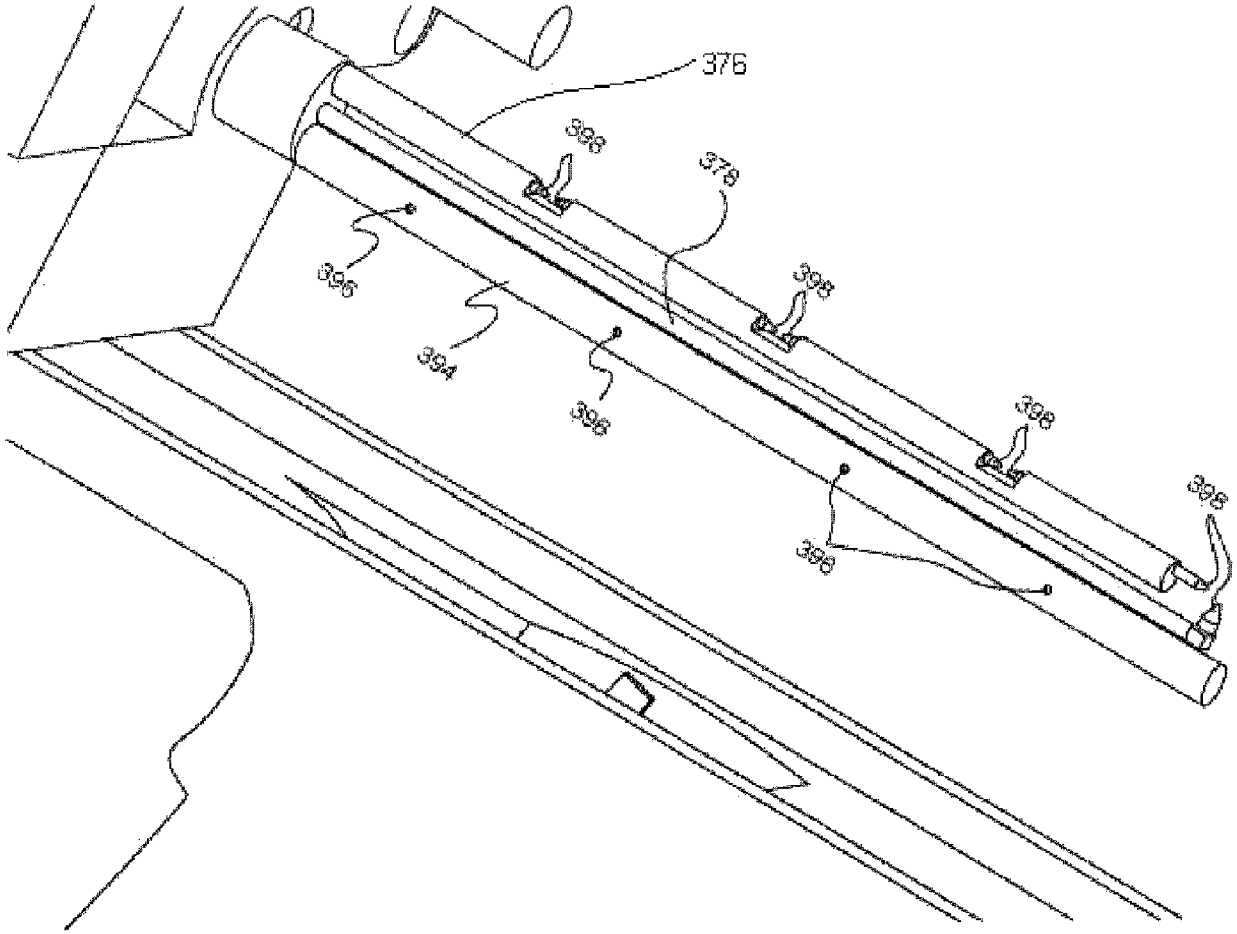
FIG. 17 is a close-up perspective view of the fuel tube spark holder.

In FIG. 17 a close up perspective view of fuel tube spark holder 362. In propellant, oxidizer introduction tube 394 is a plurality of orifice holes 396. The orifice holes 396 introduce propellant into the cylinder for a more homogenous propellant oxidizer mix. Spark wire 376 is separated in the cylinder at a plurality of spark gap points 398 to start combustion at multi points in the cylinder for a more complete combustion. The most interior spark gap point 398 works in conjunction with ground wire 378 and ignition module 322 to complete the ignition circuit.

Figure 18:
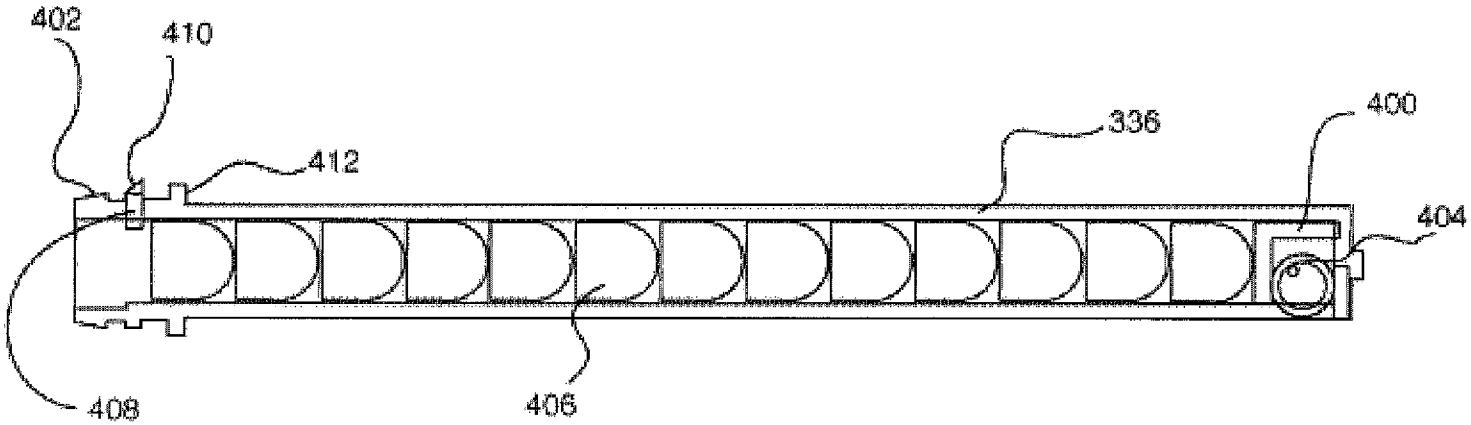
FIG. 18 is a cross sectional view of the magazine.

FIG. 18 is a cross sectional view of magazine 336. Located in magazine 336 is projectile plunger 400. Projectile plunger 400 is biased towards conical end of magazine 402 by constant force spring 404. Constant force spring 404 works in conjunction with projectile plunger 400 to move projectile 406 through shuttle plate 324 into projectile shuttle 338. Also shown in FIG. 18 is projectile magazine storage lock 408. Projectile magazine storage lock 408 holds multiple projectiles 406 in magazine 336 during storage. When magazine is installed in recess 380 angled contact face 410 is depressed and projectile magazine storage lock 408 moves axially to release multiple projectiles 406 which can be sequentially moved though shuttle plate 324 into projectile shuttle 338 as projectile shuttle 338 comes into alignment with hole aligned with recess 380 in shuttle plate 324. Also in FIG. 18 is stop shoulder 412 which limits insertion of magazine 336.

Figure 19A:
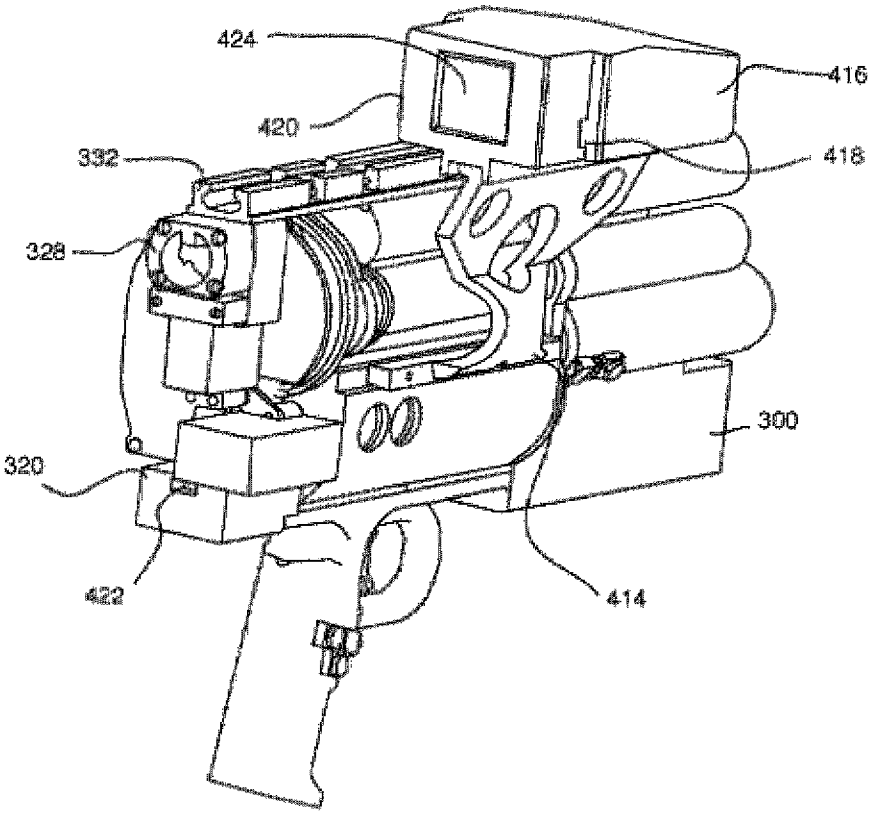
FIG. 19*a* is a rear right side perspective view of the launcher including the rangefinder assembly, a host weapon mounting rail receiver and stock adapter receiver.

FIG. 19*a* is a rear right side perspective view of launcher 300. Mounted on launcher 300 is rangefinder bracket 414. Rangefinder bracket 414's design is bidirectional in that it can be mounted on the right or left side of Launcher 300. In FIG. 19*a* the rangefinder sight 416 is mounted to rangefinder bracket on the right side of launcher 300. On rangefinder sight 416 is right communication port 418. A similar left communication port 420 is located on the left side of the rangefinder sight 416. Also on rangefinder sight 416 is display 424. On microprocessor electronics 320 is common communication port 422. Also shown in FIG. 19*a* are host weapon mounting rail receiver 332 and stock adapter receiver 328. In FIG. 19*a* launcher 300 is shown in under mount configuration to be attached below the barrel of a host weapon such as a M4 or an AR15. In this configuration stock adapter 340 has been removed.

Figure 19B:
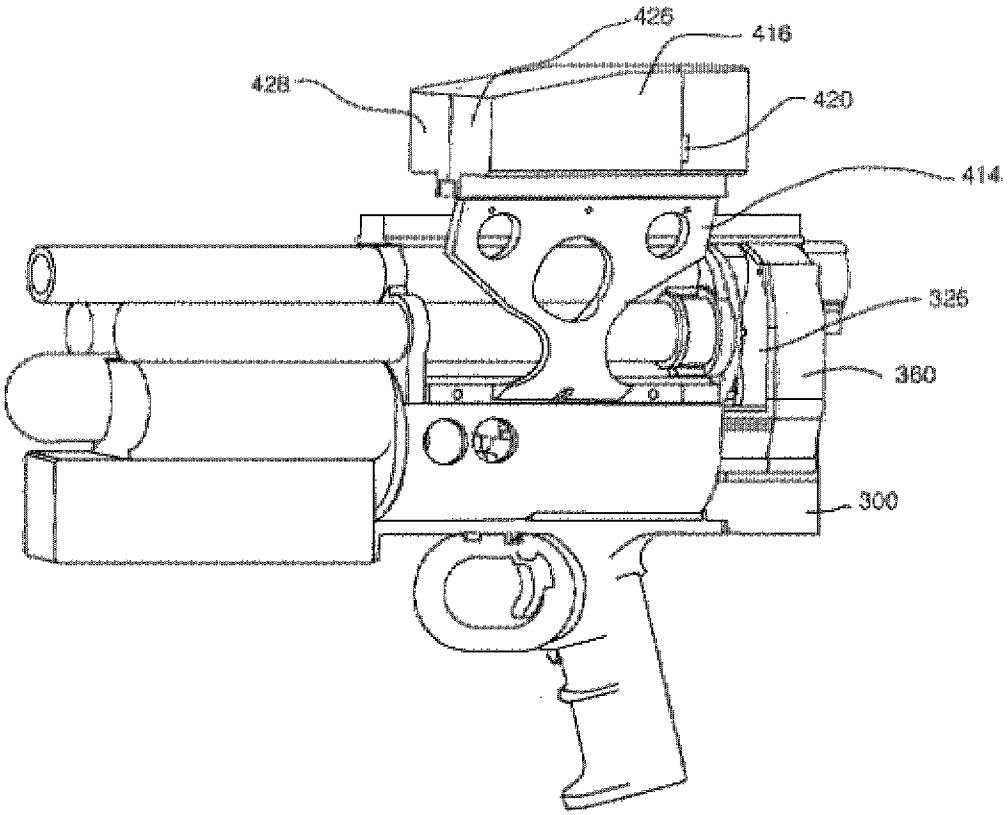
FIG. 19*b* is a front left side perspective view of the launcher. It includes the rangefinder sight as well as the rangefinder emitter and rangefinder detector.

FIG. 19*b* is a front left side perspective view of launcher 300. Rangefinder bracket 414 has been repositioned to left side of launcher 300. Rangefinder sight 416 also has been repositioned to the left side of launcher 300. On forward portion of rangefinder sight is rangefinder emitter 426 as well as rangefinder detector 428 which could have see through optics for operator sighting of intended target.

Figure 19C:
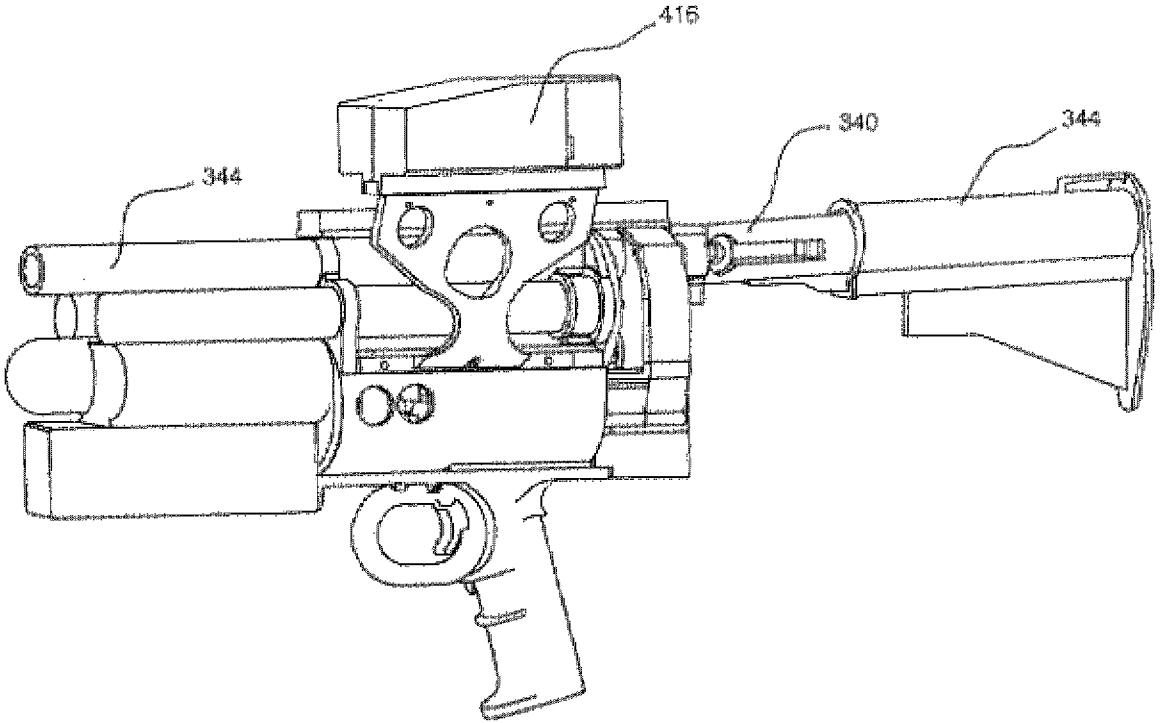
FIG. 19*c* is a left side perspective view of the launcher. the stock adaptor and M4 stock has been shown for standalone operation with the rangefinder sight and barrel being added for reference.

FIG. 19*c* is a left side perspective view of launcher 300. Stock adapter 340 has been added as well as M4 stock 344 for standalone operation. Rangefinder sight 416 and barrel 334 have been added for reference.

Figure 20A:
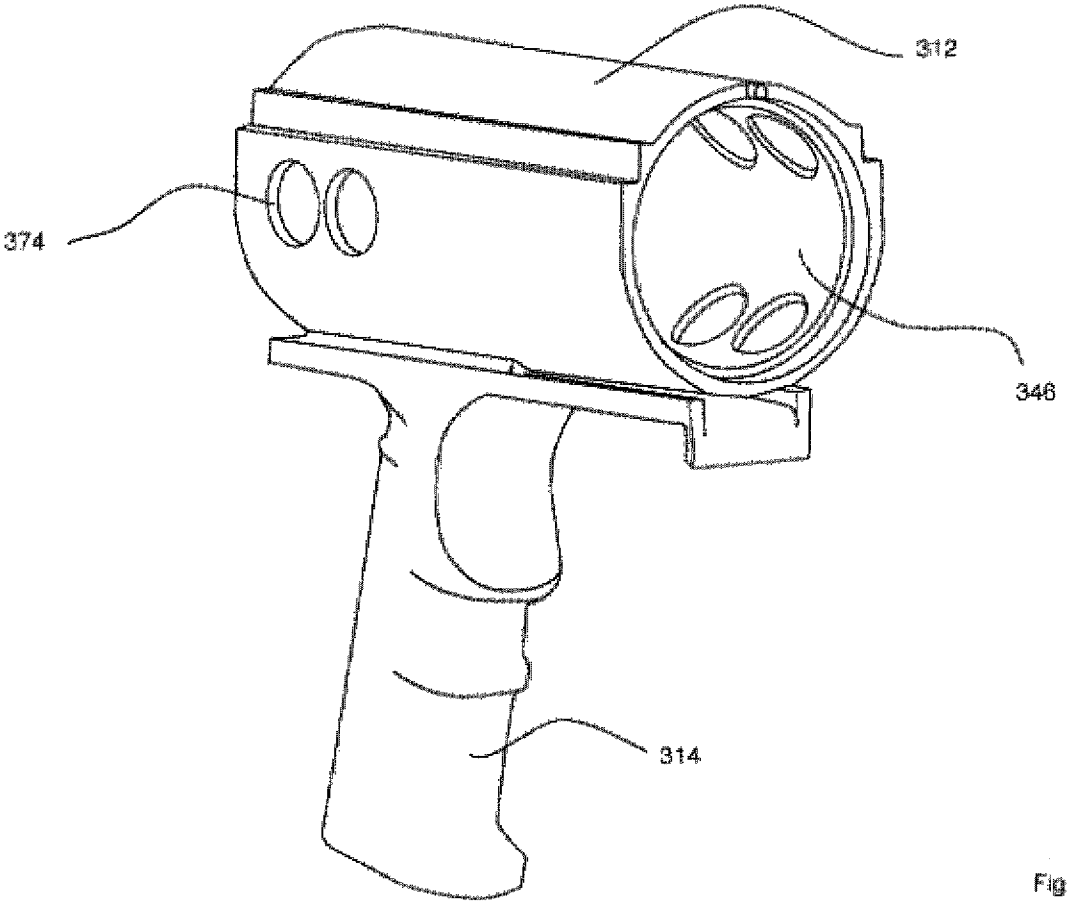
FIG. 20*a* is a component close-up view of the cylinder, valve sleeve and pistol grip with the valve sleeve positioned where the exhaust and intake scavenging ports are closed by the valve sleeve to exclude moisture and debris.

FIG. 20*a* is a component close up view of cylinder 312, valve sleeve 346, and pistol grip 314. Valve sleeve 346 has been rotated by intelligent gear box 350 through small gear 354 and large gear 356 to a position where exhaust scavenging ports 374 and intake scavenging ports 375 are closed by valve sleeve 346. This is the normal non operational position of valve sleeve 346 to exclude moisture and debris.

Figure 20B:
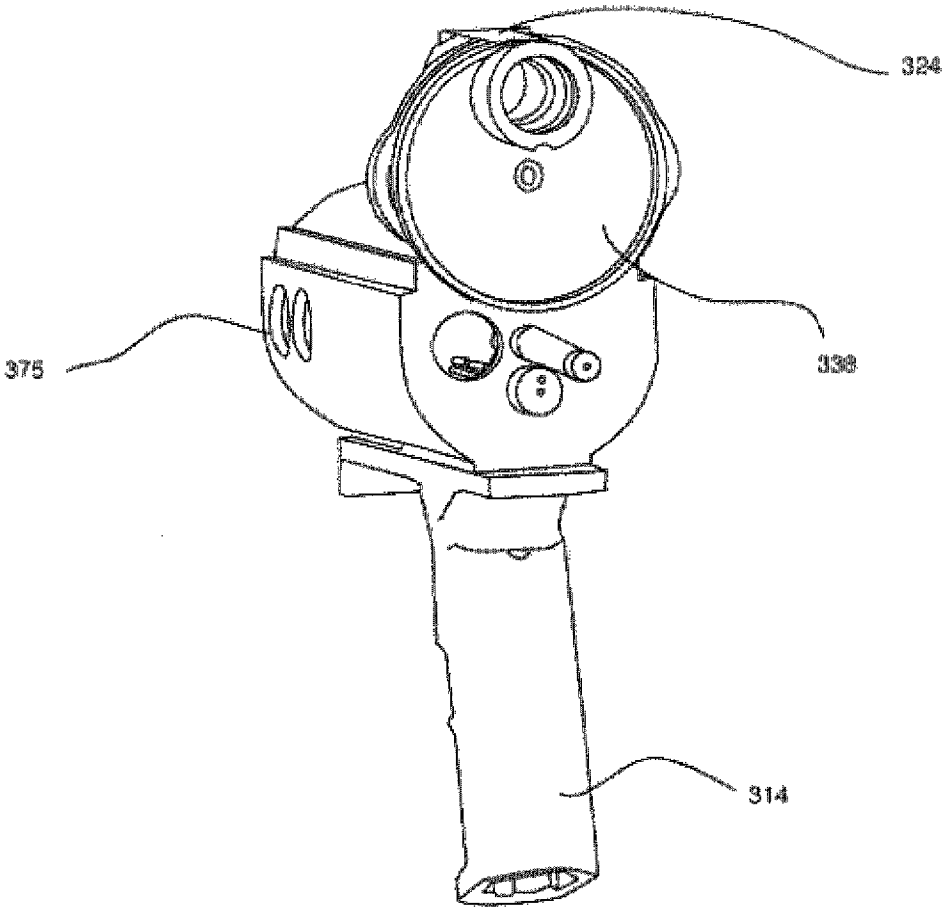
FIG. 20*b* is a close-up view of the shuttle plate, projectile shuttle and intake scavenging ports wherein the projectile shuttle is in alignment with the barrel to allow combustion pressure to push a projectile through the barrel.

FIG. 20*b* is a close up view of shuttle plate 324, projectile shuttle 338, and intake scavenging ports 375. Projectile shuttle 338 is in alignment with bore of barrel 334 to allow combustion pressure to push projectile 406 through barrel 334.

Figure 20C:
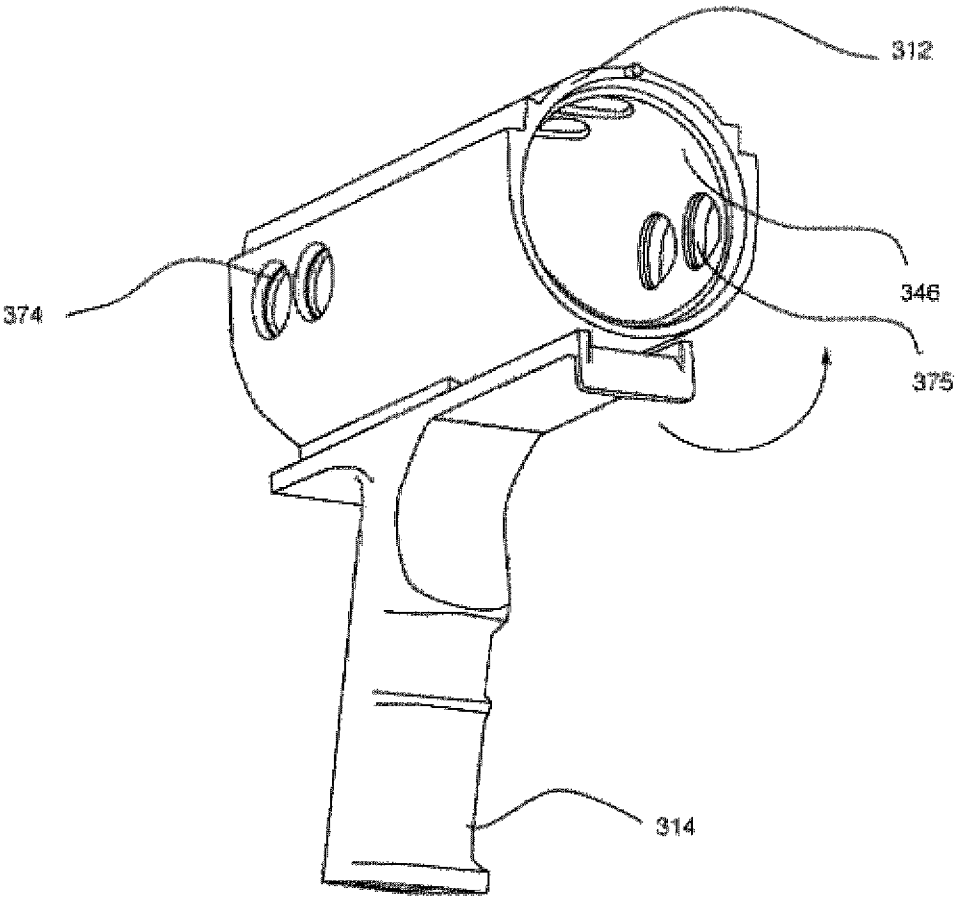
FIG. 20*c* is a component close-up view of the cylinder and valve sleeve wherein the valve sleeve has been rotated to where the exhaust scavenging ports and intake scavenging ports are open by the valve sleeve to allow for the passage of fresh air intake into the cylinder and the flow of spent combustion by products out of the cylinder.

FIG. 20*c* is a component close up view of cylinder 312, valve sleeve 346, and pistol grip 314. Valve sleeve 346 has been rotated by intelligent gear box 350 through small gear 354 and large gear 356 to a position where exhaust scavenging ports 374 and intake scavenging ports 375 are open by valve sleeve 346. In this position exhaust scavenging ports 374 and intake scavenging ports 375 allow for the passage of fresh intake air into the cylinder and the flow of spent combustion byproducts out of the cylinder. The valve sleeve 346 has been rotated to a position 45 degrees counter clockwise as viewed from the rear of launcher 300.

Figure 20D:
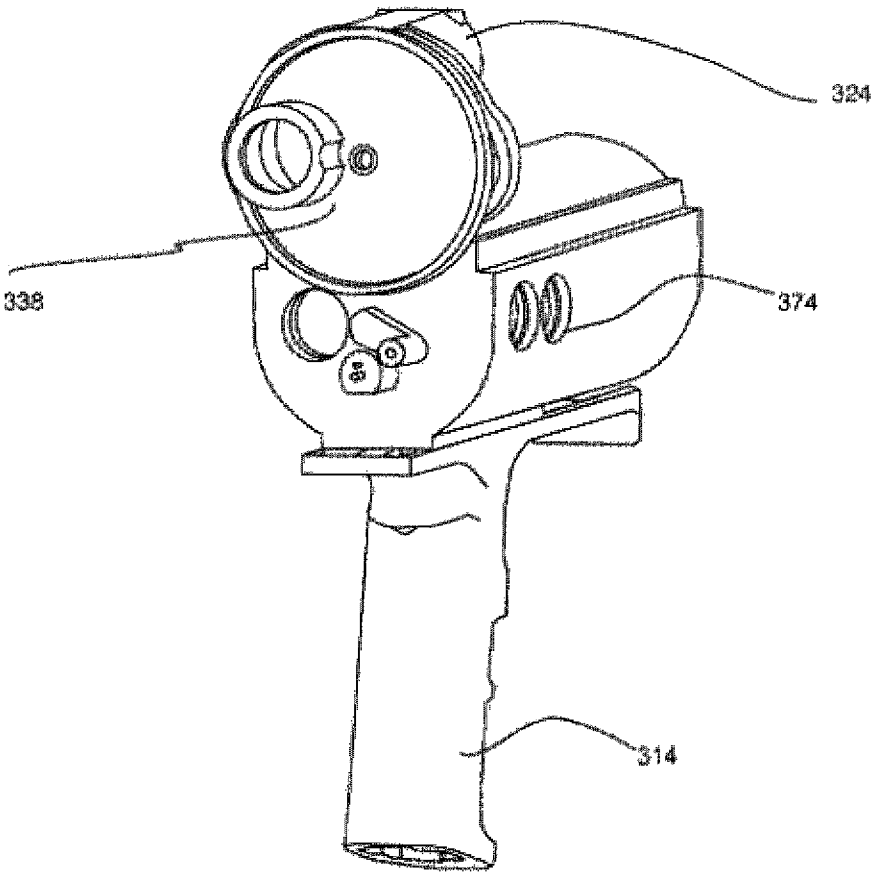
FIG. 20*d* is a close-up view of the shuttle plate and projectile shuttle with the projectile shuttle in alignment with the magazine wherein a single projectile can move into the projectile shuttle and moved into the position illustrated in FIGS. 20*a* and 20*b;*
Figure 20A:
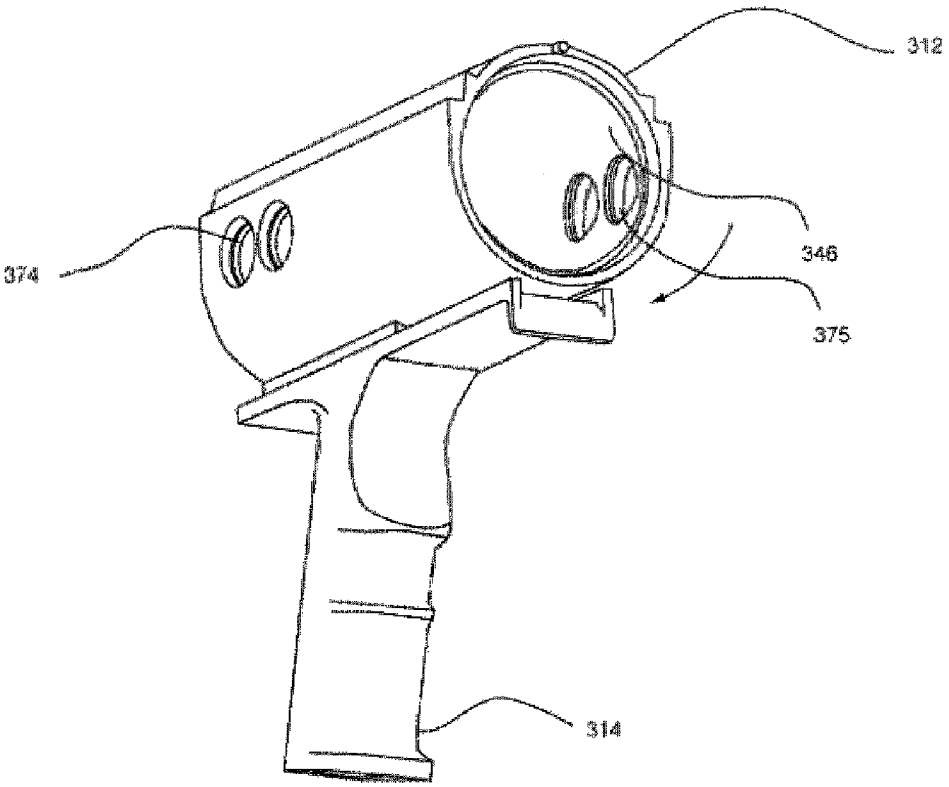

FIG. 20*d* is a close up view of shuttle plate 324, projectile shuttle 338, and exhaust scavenging ports 374. Projectile shuttle 338 is in alignment with magazine 336 in the left hand position in shuttle plate 324. In this position a single projectile 406 can move into projectile shuttle 338 and be moved into the position illustrated in FIGS. 20*a* and 20*b*.

FIG. 20*e* is a component close up view of cylinder 312, valve sleeve 346, and pistol grip 314. Valve sleeve 346 has been rotated by intelligent gear box 350 through small gear 354 and large gear 356 to a position where exhaust scavenging ports 374 and intake scavenging ports 375 are open by valve sleeve 346. In this position exhaust scavenging ports 374 and intake scavenging ports 375 allow for the passage of fresh intake air into the cylinder and the flow of spent combustion byproducts out of the cylinder. The valve sleeve 346 has been rotated to a position 90 degrees clockwise as view from the rear of launcher 300 from position illustrated in FIG. 20*c*.

Figure 20F:
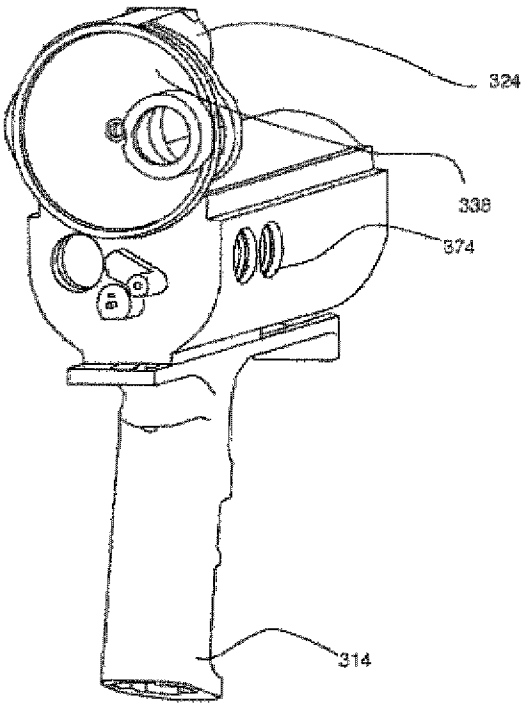
FIG. 20*f* is in a position where the projectile shuttle is in alignment with the magazine wherein a single projectile can move into the projectile shuttle and moved into the position illustrated in FIGS. 20*a* and 20*b.*

FIG. 20*f* is a close up view of shuttle plate 324, projectile shuttle 338, and exhaust scavenging ports 374. Projectile shuttle 338 is in alignment with magazine 336 in the right hand position in shuttle plate 324. In this position a single projectile 406 can move into projectile shuttle 338 and be moved into the position illustrated in FIGS. 20*a* and 20*b*.

Launcher operation is accomplished through the following sequence of steps. Operator either moves power switch 321 (FIG. 11) to ON position, or depresses trigger 316 to activate launcher 300. With launcher activated operator either selects power level through manual input buttons low 430, medium 432, and high 434. Or power levels are determined by rangefinder sight 416 (FIG. 19*a*) working in conjunction with microprocessor electronics 320. Rangefinder sight 416 has an emitter 426 which sends out a beam to the intended target. The beam is then reflected off the intended target and is collected by the detector 428. The amount of time between the beam origination from the emitter 426 and the collection at the detector 428 determines the distance to the intended target. With the distance to intended target information the microprocessor electronics 320 determines a propellant quantity to deliver the desired results at the intended target.

Once the intended target distance or operator power level has been determined the microprocessor electronics 320 energizes scavenging propellant oxidizer mixing fan motor 364 (FIG. 12) to rotate scavenging propellant oxidizer mixing fan 366 at a speed that would correspond to the desired results at the intended target. Scavenging propellant oxidizer mixing fan 366 speed determines how homogeneous the propellant oxidizer mix is in the cylinder. Higher energy levels require a more complete mix than do lower power levels. Concurrently the microprocessor electronics 320 energizes intelligent gear box 350 (FIG. 12) that is mechanically connected to projectile shuttle 338 which is rotated to a position that aligns projectile shuttle 338 with recess 380 for the desired magazine 336. Also connected to output of intelligent gear box 350 is small gear 354 (FIG. 14) that is in mesh with large gear 356. Small gear 354 is moved the same number of degrees as projectile shuttle 338. Large gear 356 rotates a proportional amount compared to small gear 354. Attached to large gear 356 is valve sleeve link 358 connected to valve sleeve bell crank 348 which is mechanically connected through cylinder 312 to valve sleeve 346 to open exhaust scavenging ports 374 and intake scavenging ports 375 (see FIG. 20*c*). With projectile shuttle 338 rotated to alignment with magazine 336 projectile 406 (FIG. 18) can move through shuttle plate 324 and enter projectile shuttle 338. Microprocessor electronics 320 energizes intelligent gear box 350 to rotate projectile shuttle 338 into alignment with barrel 334.

Propellant regulator 390 (see FIG. 16) reduces propellant pressure from propellant canister 306. Propellant regulator 390 is mechanically connected to propellant canister 306. Propellant output hose 392 transfers propellant from propellant regulator 390 to propellant solenoid 357. Oxidizer regulator 382 reduces oxidizer pressure from oxidizer canister 306. Mechanically connected to oxidizer canister 308 is oxidizer regulator 382. At the output of oxidizer regulator 382 is filter 384. Connected to filter 384 is check valve 386. Oxidizer hose 392 is connected to output of check valve 386 and to oxidizer solenoid 359.

Microprocessor electronics 320 energizes propellant solenoid valve 357 for a determined amount of time through manual input from buttons low 430, medium 432, or high 434 (FIG. 11) or from input from rangefinder sight 416 (FIG. 19*a*). If higher levels of power are required to deliver desired results at the intended target microprocessor electronics 320 may energize propellant solenoid valve 357 for a longer period of time as well as oxidizer solenoid valve 359. This enhanced propellant; oxidizer mixture can deliver higher energy levels than propellant alone.

Output from propellant solenoid valve 357 and oxidizer solenoid valve 359 are plumbed together to output hose 372. Output hose 372 is connected to propellant, oxidizer tube spark holder 362. Propellant, oxidizer tube spark holder 362 introduces propellant or a propellant oxidizer mixture into cylinder 312. In propellant, oxidizer introduction tube 394 is a plurality of orifice holes 396 (FIG. 17). The orifice holes 396 introduce propellant or propellant oxidizer mix into the cylinder for a more homogenous propellant oxidizer mix.

During the previous operations the scavenging fan motor 364 has continued to rotate scavenging propellant oxidizer mixing fan 366 at an appropriate speed for the desired power level.

Microprocessor electronics 320 energizes ignition module 322. Ignition module 322 provides a high voltage signal to spark wire 376 (FIG. 17). Spark wire 376 is separated in the cylinder at a plurality of spark gap points 398 to initiate combustion at multipoints in the cylinder. The high voltage signal flows back to ignition module 322 through ground wire 378.

The subsequent combustion in the cylinder 312 increases the pressure in the cylinder 312 which in turn acts upon the anterior portion of the projectile 406 to move projectile 406 through barrel 334. Although as illustrated here barrel 334 contains rifling lands 368 to impose spin on a projectile as it moved down the barrel 334 a smooth bore barrel may be used depending upon the given performance requirements.

After projectile 406 leaves barrel 334 microprocessor electronics 320 energizes intelligent gear box 350 that is mechanically connected to projectile shuttle 338 which is rotated to a position that is the projectile shuttle 338 in alignment with recess 380 for the desired magazine 336. Also connected to output of intelligent gear box 350 is small gear 354 that is in mesh with large gear 356. Small gear 354 is moved the same number of degrees as projectile shuttle 338. Large gear 356 rotates a proportional amount compared to small gear 354. Attached to large gear 356 is valve sleeve link 358 connected to valve sleeve bell crank 348 which is mechanically connected through cylinder 312 to valve sleeve 346 to open exhaust scavenging ports 374 and intake scavenging ports 375. Scavenging fan motor 364 rotates scavenging fan 366 at an appropriate speed for the desired power level to draw fresh air in to cylinder 312 and to sweep out spent combustion by products.

If operation is complete projectile shuttle 338 returns to a position in alignment with barrel 334 and scavenging fan motor 364 ceases to operate. Microprocessor electronics 320 places launcher 300 into standby mode until input from operator.

If additional launches are desired and trigger 316 has remained depressed projectile shuttle 338 is rotated to a position that aligns projectile shuttle 338 with recess 380 for the desired magazine 336. The operational cycle is repeated until trigger 316 is released. The microprocessor electronics 320 allows for different scenarios of operation with automatic escalation of force possible as well as automatic selection of different projectiles 406 with each launch.

It is intended to cover by the appended claims all embodiment that fill within the true spirit and scope of the invention.

The invention claimed is:

1. A projectile launcher assembly comprising a gun, a housing for said gun including a gun barrel and at least one magazine for supplying projectiles to said barrel, a combustion chamber, means for supplying fuel to said combustion chamber, said combustion chamber includes inlet and outlet ports, a valve sleeve for controlling the opening and closing of said ports, a projectile shuttle, gear box means mechanically connected to the valve sleeve and projectile shuttle, a trigger assembly for controlling the operation for said launcher, an ignition device for igniting said fuel, mechanisms for regulating and controlling the fuel flow to set the velocity of the projectile exiting from the barrel to fire the projectile in a lethal or non-lethal mode from said combustion chamber which also includes range finding means for measuring the distance to an intended target and microprocessor electronics responsive to energize the gear box means to control the valve sleeve to open and close said ports and rotate the projectile shuttle into alignment with the barrel to fire subsequent projectiles and obtain the desired results at the intended target.

2. The projectile launcher of claim 1, wherein the gear box means includes a small gear to move the projectile shuttle the requisite amount to move a projectile from the magazine into the barrel and a large gear to move the valve sleeve to control the opening of the inlet and outlet ports.

3. The projectile launcher of claim 2, wherein the trigger assembly when depressed effectuates automatic operation of the launcher and when released the microprocessor and fan motor cease to operate and the launcher is placed into a standby mode.

4. A projectile launcher assembly comprising a gun having a housing including a barrel for firing projectiles at a lethal or non-lethal velocity, the housing including a combustion chamber that includes inlet and outlet ports, a valve sleeve for controlling the opening and closing of said ports, a projectile shuttle, gear box means mechanically connected to the valve sleeve and projectile shuttle, a trigger assembly for controlling the operation of said launcher, microprocessor electronics responsive to energize the gear box means to control the valve sleeve to open and close said ports and rotate the projectile shuttle into alignment with the barrel to fire subsequent projectiles, a fuel container for propellant fuel under pressure, first conduit means interconnecting the fuel container and combustion chamber, adjusting means for selectively controlling the pressure and flow of fuel to said chamber including mechanisms for selectively admitting fuel to fire a projectile exiting from the barrel in a lethal or a non-lethal mode, a power operated ignition device for igniting the fuel in said chamber, second conduit means connecting the combustion chamber and barrel for exiting the projectile from the barrel at the velocity set by the adjusting means.

5. The projectile launcher of claim 4, further comprising range finding means for measuring the distance to an intended target and microprocessor electronics responsive to the measured distance to determine a propellant fuel quantity.

6. The projectile launcher of claim 5, further comprising a mixing fan in the combustion chamber, wherein the microprocessor electronics energize the mixing fan to rotate at a speed that would correspond to the desired results at the intended target.

7. The projectile launcher of claim 5, wherein the ignition device includes an ignition module energized by said microprocessor electronics, wherein the ignition module includes a high voltage signal to a spark wire separated in the combustion chamber at a plurality of spark gap points to initiate combustion at multiple points in the chamber.

8. The projectile launcher of claim 4, further comprising regulating means for establishing a distance the projectile is to be fired.

9. The projectile launcher of claim 8, wherein the regulating means includes manual control means for establishing the distance the projectile is to be fired.

10. The projectile launcher of claim 8, wherein the microprocessor electronics respond to the regulating means for establishing the distance the projectile is to be fired.

11. The projectile launcher of claim 4, further comprising exhaustion means for exhausting the combustion chamber after firing, the exhaustion means comprising a piston having exhaust passages closed by valve means, means for moving the piston after firing and opening said valve means to allow exhaust gases to flow to atmosphere.

12. A projectile launcher comprising a trigger assembly, an ignition device, a gun barrel, a projectile shuttle, and a loading means to load a projectile to the gun barrel, the projectile launcher further comprising:

a microprocessor;

a range finder for determining a range to an intended target and for communicating the determined range to the microprocessor, the microprocessor being configured to determine a quantity of fuel based on the determined range;

a combustion chamber comprising inlet and outlet ports;

a velocity-setting means for setting the velocity of a launched projectile, the velocity-setting means comprising a fueling means for regulating and controlling delivery of the determined quantity of fuel to the combustion chamber;

a valve sleeve for controlling the opening and closing of the inlet and outlet ports of the combustion chamber; and a gear box means mechanically connected to the valve sleeve and to the projectile shuttle, wherein the microprocessor is further configured to be responsive to activation of the trigger assembly to (i) activate the ignition device and (ii) energize the gear box means to (a) control the valve sleeve to open and close the inlet and outlet ports of the combustion chamber and (b) rotate the projectile shuttle into alignment with the gun barrel for subsequent launching of projectiles.

13. The projectile launcher of claim 12, further comprising a fan configured to mix the fuel in the combustion chamber.

14. The projectile launcher of claim 13, wherein the fan is configured to exhaust the combustion chamber after the activation of the ignition device.

15. The projectile launcher of claim 12, wherein the velocity-setting means further comprises a fan for mixing the determined quantity of fuel in the combustion chamber.

16. The projectile launcher of claim 12, further comprising an oxidizer-supply means.

17. The projectile launcher of claim 12, further configured to mount on a host weapon.

18. The projectile launcher of claim 12, wherein the microprocessor is further configured to be responsive to the trigger assembly remaining activated after a launch of a first projectile to repeat a launch sequence to launch a second projectile.

* * * * *